United States Patent [19]

Fujimoto et al.

[11] Patent Number: 4,837,132

[45] Date of Patent: Jun. 6, 1989

[54] METHOD FOR PROCESSING SILVER HALIDE COLOR PHOTOGRAPHIC MATERIAL USING A CHELATING AGENT AND DEVELOPER WITH SUBSTANTIALLY NO BENZYL ALCOHOL

[75] Inventors: Hiroshi Fujimoto; Takatoshi Ishikawa, both of Kanagawa, Japan

[73] Assignee: Fuji Photo Film Co., Ltd., Kanagawa, Japan

[21] Appl. No.: 54,176

[22] Filed: May 26, 1987

[30] Foreign Application Priority Data

May 23, 1986 [JP] Japan ..... 61-118848
May 23, 1986 [JP] Japan ..... 61-118849

[51] Int. Cl.[4] ..... G03C 5/24; G03C 7/30

[52] U.S. Cl. ..... 430/380; 430/434; 430/435; 430/441; 430/463; 430/467; 430/468; 430/469; 430/484

[58] Field of Search ..... 430/380, 434, 435, 441, 430/463, 467, 468, 469, 484

[56] References Cited

U.S. PATENT DOCUMENTS

| | | | |
|---|---|---|---|
| 3,996,054 | 12/1976 | Santemma et al. | 430/377 |
| 4,035,188 | 7/1977 | Yabata et al. | 430/467 |
| 4,299,914 | 11/1981 | Fujumastu et al. | 430/552 |
| 4,304,844 | 12/1981 | Fujumoto et al. | 430/552 |
| 4,336,324 | 6/1982 | Koboshi et al. | 430/421 |
| 4,443,536 | 4/1984 | Lestina | 430/552 |
| 4,454,224 | 6/1984 | Brien et al. | 430/393 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Saraki et al. | 430/552 |
| 4,565,777 | 1/1986 | Ogawa et al. | 430/552 |

FOREIGN PATENT DOCUMENTS

| | | | |
|---|---|---|---|
| 211437 | 2/1987 | European Pat. Off. . | |
| 29461 | 8/1974 | Japan . | |
| 0025632 | 2/1977 | Japan | 430/467 |
| 52058 | 4/1980 | Japan . | |
| 200037 | 12/1982 | Japan . | |
| 31334 | 2/1983 | Japan . | |
| 42095 | 3/1983 | Japan . | |
| 50536 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26339 | 2/1985 | Japan . | |
| 158444 | 8/1985 | Japan . | |
| 162256 | 8/1985 | Japan . | |
| 158446 | 9/1985 | Japan . | |
| 172042 | 9/1985 | Japan . | |
| 70552 | 4/1986 | Japan . | |
| 330250 | 2/1987 | Japan . | |

OTHER PUBLICATIONS

Abstracts taken from Japanese Patent Publication 12,381 (78), Derwent, Chemical Abstracts and Japio.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method is described for processing a silver halide color photographic material after imagewise exposure, comprising color developing, desilvering, and at least one of washing and stabilizing a silver halide color photographic material, wherein a color developer which does not substantially contain benzyl alcohol but comprises at least one compound represented by formula (I)

(I)

wherein $M^1$, $M^2$, $M^3$ and $M^4$ each represents a hydrogen atom, an alkali metal ion, an ammonium ion, or 1/n of an n-valent cation is used for the color development.

10 Claims, No Drawings

METHOD FOR PROCESSING SILVER HALIDE COLOR PHOTOGRAPHIC MATERIAL USING A CHELATING AGENT AND DEVELOPER WITH SUBSTANTIALLY NO BENZYL ALCOHOL

FIELD OF THE INVENTION

This invention relates to a method for processing silver halide color photographic materials, and more particularly, to a color photographic processing method wherein the deterioration of a color developer is greatly prevented and an excellent photographic performance is obtained even when the processing time is shortened.

BACKGROUND OF THE INVENTION

Recently, in the field of color photographic light-sensitive materials, with the shortening of the time for delivery of finished products and the reduction of laboratory work, it has been desired to shorten the processing time for color photographic processing. For shortening the processing times for various processing steps, a method of increasing the processing temperature, increasing the amount of each replenisher, activating the processing composition, or adding various accelerators has been generally employed, and furthermore methods of strengthening or improving agitation of the processing solution have been also variously proposed.

However, it has been found that when water wash step is shortened to less than 2 minutes in the aforesaid cases of shortening the processing time for photographic processing steps, the formation of stains on the processed color photographic materials is increased in continuous processing.

Also, in a process for automatically performing continuous processing of general color photographic materials, the environmental preservation, the saving of silver resources, and the recovery of silver are important problems, and countermeasures for reducing the amount of wash water or a stabilizing solution, reutilizing these solutions, etc., have been investigated.

For example, for greatly reducing the amount of the replenisher for wash water or a stabilizing solution, a multistage countercurrent system wherein plural tanks for the water wash step or the stabilization step are employed and the replenisher is continuously supplied to the system has been described in U.S. Pat. No. 4,336,324.

By employing the aforesaid system, the amount of waste solutions in the photographic processing can be reduced, whereby the load for preventing the occurrence of environmental pollution is greatly reduced, and also the reduction of the amount of wash water and the reutilization of wash water can be easily practiced.

U.S. Pat. No. 4,336,324 described a stabilization process which employs plural tanks and performs the stabilization while supplying a replenisher for the stabilizing solution in a multistage countercurrent system after fixing. Since, in the processing system, the amount of the replenisher for the stabilizing solution is as small as 3 to 50 times the amount of a processing solution carried by color photographic material from the pre-bath, the amount of water can be greatly reduced, and hence the aforesaid system is an advantageous system in regard to environmental preservation and water resources, which recently have become important problems.

However, when the amount of wash water or a stabilizing solution is greatly reduced by simply employing such a multistage countercurrent system for processing color photographic materials, there occurs a problem in that the occurrence of stains after processing becomes severe.

Such stain is particularly perceivable in reflective photographic materials, and hence becomes, as a matter of course, a serious problem in practical case.

From the facts that these stains are removed by rewashing with water, do not occur when the washing time in the photographic processing is sufficiently prolonged, or do not occur when a fresh color developer is used, it is considered that such stain is caused by oxidized components of a color developer, which remains on the color photographic materials without being sufficiently washed away.

Hitherto, for improving the stability of color developers various kinds of preservatives and chelating agents have been investigated. Examples of preservatives include aromatic polyhydroxy compounds described in Japanese Patent Application (OPI) Nos. 49828/77, 160142/84, and 47038/81 (the term "OPI" as used herein means an "unexamined published application"), U.S. Pat. No. 3,746,544, etc., the hydroxycarbonyl compounds described in U.S. Pat. No. 3,615,503, British Pat. No. 1,306,176, etc., the α-aminocarbonyl compounds described in Japanese Patent Application (OPI) Nos. 143020/77, 89425/78, etc., and the metal salts described in Japanese Patent Application (OPI) Nos. 44148/82, 53749/82, etc.

Examples of chelating agents include aminopolycarboxylic acids described in Japanese Patent Publication Nos. 30496/73, 30232/69, etc., the organic phosphonic acids described in Japanese Patent Application (OPI) No. 97347/81, Japanese Patent Publication No. 39359/81, and West German Pat. No. 2,227,639, the phosphonocarboxylic acids described in Japanese Patent Application (OPI) Nos. 102726/77, 43730/78, 121127/79, 126241/80, 65956/80, etc., and the compounds described in Japanese Patent Application (OPI) Nos. 195845/83, 203440/83, Japanese Patent Publication No. 40900/78, etc.

However, even when these compounds are used, a sufficient preservability is not obtained and also the increase of the occurrence of stains on the processed color photographic materials is observed in the case that the time for water wash step or stabilization step is short or the amount of the replenisher for the wash step or stabilization step is reduced.

Also, it is well known to use benzyl alcohol for a color developer for improving the coloring property, but the use of benzyl alcohol involves various problems such as that the solubility thereof in the processing solution is poor, the increasing the time required for the preparation of the processing solution, the color developer containing benzyl alcohol forms tars with the passage of time, and, as to photographic properties, conversion of leuco cyan dye becomes incomplete and the storage stability of color images after processing is reduced.

On the other hand, a technique for improving the stability of a color developer by adding a compound shown by formula (I) described hereinbelow to the color developer is known as disclosed in Japanese Patent Publication No. 12381/78. However, when the compound is used in the presence of benzyl alcohol, the effect may be obtained to some extent as described in the example of the aforesaid patent publication, but in the wash step or the stabilization step of a shortened processing time or in the case of reducing the amount of the replenisher for the wash step or the stabilization step as described above, an increase of staining (in particular, yellow stains) is observed and the effect of using the compound described above is insufficient.

SUMMARY OF THE INVENTION

The first object of this invention is, therefore, to provide a method for processing color photographic materials, which shows a stable property without forming stains even in the method of a shortened processing time.

The second object of this invention is to provide a stable processing solution the deterioration of which with the passage of time is prevented.

The third object of this invention is to provide a method for processing color photographic materials wherein the wash step or the stabilization step is performed by a multistage countercurrent system with a reduced amount of replenisher for the processing solution, which gives stable photographic performance with less formation of stains after processing.

As the result of extensive investigations, the inventors have discovered that the aforesaid objects of this invention can be attained by a method for processing an imagewise exposed silver halide color photographic material with a color developer which does not substantially contain benzyl alcohol, but which comprises a compound represented by formula (I)

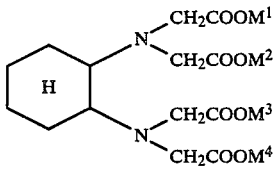

(I)

wherein $M^1$, $M^2$, $M^3$ and $M^4$ each represents a hydrogen atom, an alkali metal ion, an ammonium ion, or 1/n of an n-valent cation.

DETAILED EXPLANATION OF THE INVENTION

The invention is explained in more detail below.

Preferred examples of the alkali metal ion include $K^+$, $Na^+$, and $Li^+$. Preferred examples of the n-valent cation include $Mg^{2+}$, $Ca^{2+}$, $Al^{3+}$, $Fe^{3+}$, which may form a complex with two or more of the —$COOH^-$ groups in the state of dissociation, etc. or form a metal chelate with another compound of formula (I).

As indicated above, an important feature of this invention is in the point of processing a color photographic material with a color developer which does not substantially contain benzyl alcohol, but which does comprise the compound represented by formula (I) described above.

The addition amount of the compound represented by formula (I) is generally from 0.001 g to 30 g, preferably from 0.005 g to 10 g, more preferably from 0.01 g to 5 g per liter of the color developer.

Specific examples of the compound represented by formula (I) are 1,2-cyclohexanediamine-N,N,N',N'-tetraacetic acid, and the sodium salt, potassium salt, lithium salt, and ammonium salt thereof.

It is known as described above that color photographic materials are processed by a color developer containing the compound of formula (I). However, the increase of stains in the case of employing a water wash step or stabilization step of a shortened processing time or reducing the amount of the replenisher for the processing solution in a water wash step or stabilization step cannot sufficiently be inhibited simply by the use of the aforesaid compound in a conventional color developer containing benzyl alcohol.

The inventors have confirmed that the formation of stains is caused by the attachment of oxidized components of a color developer onto the color photographic material processed by the color developer, and also that benzyl alcohol, which is a component of the color developer, takes part in the formation or attaching of the oxidized components.

Prior to the present invention, it was completely unexpected that the formation of stains in the case of the aforesaid shortened processing time or reduced amount of the replenisher for water wash step or stabilization step could be effectively inhibited as it has by the present invention method for processing color photographic materials with a color developer which does not substantially contain benzyl alcohol, but which comprises the compound represented by formula (I) according to this invention.

The color developer for use in this invention contains an aromatic primary amine color developing agent such as, preferably, p-phenylenediamine derivatives.

Specific examples of these color developing agents are illustrated below, but the color developing agents for use in this invention are not limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methoxy-N-ethyl-N-β-ethoxyethylaniline D-11: 4-Amino-3-methyl-N-ethyl-N-β-butoxyethylaniline.

Also, the aforesaid compounds may be in the form of the sulfates, hydrochlorides, sulfites, p-toluenesulfonates, etc.

The amount of the aromatic primary amine developing agent is generally from about 0.1 g to about 20 g, and preferably from about 0.5 g to about 10 g per liter of the color developer.

The color developer for use in this invention may further contain a hydroxylamines as known in the art so as to prevent oxidation of the color developing agent.

The hydroxylamine may be used in the form of the free amine in the color developer, but is more generally used as the form of the water-soluble acid salt thereof. Examples of these salts are sulfates, oxalates, chlorides, phosphates, carbonates, acetates, etc. The hydroxylamines may be or may not be substituted, and also the nitrogen atom of the hydroxylamine may be substituted by an alkyl group.

The addition amount of the hydroxylamine is generally up to 0.5 mol, preferably up to 0.1 mol per liter of the color developer.

Moreover, the color developer may further contain a sulfite such as sodium sulfite, potassium sulfite, sodium bisulfite, potassium bisulfite, sodium metasulfite, potassium metasulfite, etc., or a carbonyl-sulfurous acid addition product as a preservative. The addition amount of the preservative is up to 20 g, preferably up to 5 g per liter of the color developer. The amount of the preservative is, however, preferably as small as possible if the stability of the color developer is maintained.

Other preservatives include hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamides, condensed ring amines, as described in Japanese Patent Application Nos. 280792/86, 286741/86, 295002/86 and 315535/86; hydroxyacetones described in U.S. Pat. No. 3,615,503 and British Pat. No. 1,306,176, α-aminocarbonyl compounds described in Japanese Patent Application (OPI) Nos. 143020/77 and 89425/78, various kinds of metal salts described in Japanese Patent Application (OPI) Nos. 44148/82 and 53749/82, various kinds of saccharides described in Japanese Patent Application (OPI) No. 102727/77, hydroxamic acids described in Japanese Patent Application (OPI) No. 27638/77, α,α'-dicarbonyl compounds described in Japanese Patent Application (OPI) No. 160141/84, salicylic acids described in Japanese Patent Application (OPI) No. 180588/84, alkanolamines described in Japanese Patent Application (OPI) No. 3532/79, poly(alkyleneimines) described in Japanese Patent Application (OPI) No. 94349/81, gluconic acid derivatives described in Japanese Patent Application (OPI) No. 75647/81, and aromatic polyhydroxy compounds described in U.S. Pat. No. 3,746,544, Japanese Patent Application (OPI) Nos. 47038/81 and 160142/84.

These preservatives may be used singly or as a combination thereof.

The pH of the color developer for use in this invention is preferably from about 9 to about 12, more preferably from about 9 to about 11.0, and the color developer may further contain various additives which are ordinarily employed for color developers.

For maintaining the aforesaid pH of the color developer, it is preferred to use various buffers. Examples of such buffers include carbonates, phosphates, borates, tetraborates, hydroxybenzoates, glucine salts, N,N-dimethylglycine salts, leucine salts, norleucine salts, guanine salts, 3,4-dihydroxyphenylalanine, alanine salts, aminobutyrates, 2-amino-2-methyl-1,3-propanediol salts, valine salts, proline salts, trishydroxyaminomethane salts, lysine salts, etc. In particular, the use of carbonates, phosphates, tetraborates, and hydroxybenzoates are preferred since they have advantages in that they have excellent solubility, they are excellent in buffer action in the high pH range of higher than 9.0, they have no adverse influences (e.g., the formation of fog, etc.), on the photographic performance when they are added to the color developer, and they are available at low cost.

Specific examples of these buffers are sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not limited to these compounds.

The addition amount of the buffer is preferably not less than 0.1 mol, and more preferably from 0.1 mol to 0.4 mol, per liter of the color developer.

Furthermore, the color developer for use in this invention can contain various chelating agents as a precipitation preventing agent for calcium and magnesium and for improving the stability of the color developer in addition to the compound shown by formula (I) described above.

As the chelating agent, organic acid compounds are preferably used and examples of such chelating agents include aminopolycarboxylic acids described in Japanese Patent Publication Nos. 30496/73 and 30232/69, organic phosphonic acids described in Japanese Patent Application (OPI) No. 97347/81, Japanese Patent Publication No. 39359/81, and West German Pat. No. 2,227,639, phosphonocarboxylic acids described in Japanese Patent Application (OPI) Nos. 102726/77, 42730/78, 121127/79, 126241/80, 65956/80, and also the compounds described in Japanese Patent Application (OPI) Nos. 195845/83, 203440/83, and Japanese Patent Publication No. 40900/78.

Specific examples of the chelating agent are illustrated below, but the invention is not limited to these compounds.

Nitrilotriacetic acid
Diethylenetriaminepentaacetic acid
Triethylenetetraminehexaacetic acid
N,N,N-Trimethylenephosphonic acid Ethylenediamine-N,N,N',N'-tetramethylenephosphonic acid
1,3-Diamino-2-propanol-tetraacetic acid
Ethylenediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetetraacetic acid
Ethylenediamineorthohydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid These chelating agent may be used, if desired, as a mixture thereof.

The amount of the chelating agent(s) may be one sufficient for blocking metal ion(s) in the color developer and is generally from about 0.1 g to about 10 g per liter of the color developer.

The color developer for use in this invention may contain, if desired, an optional development accelerator. However, the color developer does not substantially contain benzyl alcohol or contains not more than 2 ml, and preferably not more than about 0.5 ml, per liter of the color developer.

Examples of the development accelerator which can be used in this invention include thioether compounds described in Japanese Patent Publication Nos. 16088/62, 5987/62, 7826/63, 12380/69, 9019/70, and U.S. Pat. No. 3,813,247, p-phenylenediamine series compounds described in Japanese Patent Application (OPI) Nos. 49829/77 and 15554/75, quaternary ammonium salts described in Japanese Patent Publication No. 30074/79, Japanese Patent Application (OPI) Nos. 137726/75, 156826/81, and 43429/77, p-aminophenols described in U.S. Pat. Nos. 2,610,122 and 4,119,462, amine series compounds described in U.S. Pat. Nos. 2,494,903, 3,128,182, 4,230,796, 3,253,919, 2,482,546, 2,596,926, 3,582,346, and Japanese Patent Publication No. 11431/66, polyalkylene oxides described in U.S. Pat. Nos. 3,128,183 and 3,532,501, and Japanese Patent Publication Nos. 16088/62, 25201/67, 11431/66, and 23883/67, and also 1-phenyl-3-pyrazolidones, hydrazines, mesoion type compounds, ion type compounds, imidazoles, etc.

The color developer for use in this invention may further contain, if desired, an optional antifoggant. As the antifoggant, there are alkaline metal halides such as potassium bromide, sodium chloride, potassium iodide, etc., and organic antifoggants. Examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, hydroxyazaindolizine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. In the above-described compounds, the nitrogen-containing heterocyclic compounds are particularly preferred. The antifoggant may be accumulated in the color developer dissolved from color photographic materials during processing.

It is preferred that the color developer for use in this invention contains an optional whitening agent. Preferred examples of the optical whitening agent are 4,4'-diamino-2,2'-disulfostilbene series compounds. The addition amount of the optical whitening agent is up to 5 g/liter, and preferably from 0.1 to 2 g/liter.

Also, if desired or necessary, the color developer may further contain various kinds of surface active agents such as alkylsulfonic acids, arylphosphonic acids, aliphatic carboxylic acids, aromatic carboxylic acids, etc.

The processing temperature for the color developer in this invention is generally from 20° C. to 50° C., and preferably from 30° C. to 40° C. The processing time for the color development is generally from 20 seconds to 5 minutes, and preferably from 30 seconds to 2 minutes.

The amount of the replenisher for the color developer is preferably as small as possible, but is usually from 20 ml to 600 ml, preferably from 50 ml to 300 ml, and more preferably from 100 ml to 200 ml, per square meter of the color photographic material to be processed.

In this invention, after color development, the color photographic material is subjected to desilvering processing. The desilvering step is based on a bleach step and a fix step, but these steps may be simultaneously performed as a bleach-fix step (blix step).

Specific examples of the desilvering step(s) are a bleach step and a fix step; a blix step; a bleach step and a blix step; a fix step and a blix step; and blix step and a fix step; etc. In these cases, a bath containing a desilvering accelerator may be employed before each bath, or each bath described above may be divided into two or more tanks for increasing the desilvering speed or reducing the amount of each replenisher.

Examples of bleaching agents which can be used for the bleach solution or the blix solution include potassium ferricyanide, bichromates, persulfate, inorganic ferric salts, organic ferric salts, etc., but the use of aminopolycarboxylic acid ferric complex salts is particularly preferred from the viewpoints of causing less pollution and corrosion of metals as well as high stability.

The bleaching agents may, if desired, be used as a mixture of two or more. Also, the bleaching agent in the bleach solution may be the same as or different from that in the blix solution. For example, iron chloride may be used in the case of bleach solution and an aminopolycarboxylic acid ferric complex salt may be used in the case of blix solution.

The aminopolycarboxylic acid ferric complex salt which can be used as the bleaching agent in this invention is a complex salt of a ferric ion and an aminopolycarboxylic acid or the salt thereof.

Specific examples of the aminopolycarboxylic acid are illustrated below.

A-1: Ethylenediaminetetraacetic acid
A-2: Diethylenetriaminepentaacetic acid
A-3: Ethylenediamine-N-(β-oxyethyl)-N,N',N'-triacetic acid A-4: 1,3-Diaminopropanetetraacetic acid
A-5: Triethylenetetraminehexaacetic acid
A-6: Propylenediaminetetraacetic acid
A-7: Nitrilotriacetic acid
A-8: Nitrilotripropionic acid
A-9: Cyclohexanediaminetetraacetic acid
A-10: 1,3-Diamino-2-propanoltetraacetic acid
A-11: Methyliminodiacetic acid
A-12: Iminodiacetic acid
A-13: Hydroxyliminodiacetic acid
A-14: Dihydroxyethylglycine ethyl ehter diaminotetraacetic acid
A-15: Glycol ether diaminetetraacetic acid
A-16: Ethylenediaminetetrapropionic acid
A-17: Ethylenediaminedipropionic acid
A-18: Phenylenediaminetetraacetic acid
A-19: 2-Phosphonobutane-1,2,4-triacetic acid
A-20: 1,3-Diaminopropanol-N,N,N',N'-tetramethylenephosphonic acid
A-21: Ethylenediamine-N,N,N',N'-tetramethylenephosphonic acid
A-22: 1,3-Propylenediamine-N,N,N',N'-tetramethylenephosphonic acid
A-23: 1-Hydroxyethylidene-1,1-diphosphonic acid These compounds may be in the form of sodium salts, potassium salts, lithium salts, or ammonium salts. In the aforesaid compounds, Compounds A-1, A-2, A-4, A-9, A-11, A-15, and salts thereof are preferred from the viewpoint of showing high bleaching power.

The amount of the bleaching agent is preferably from 0.05 mol to 0.5 mol, and more preferably from 0.1 mol to 0.4 mol, per mol of the processing solution.

The aminopolycarboxylic acid ferric complex salt may be used as the form of the complex salt itself or the ferric ion complex salt may be formed in the processing solution by using a ferric salt such as ferric sulfate, ferric chloride, ferric nitrate, ferric ammonium sulfate, ferric phosphate, etc., and an aminopolycarboxylic acid. In the case of use in the form of a complex salt, one kind of the complex salt may be used or two or more kinds thereof may be used. On the other hand, when the complex salt is formed in the processing solution using the ferric salt and an aminopolycarboxylic acid, the ferric salts may be used singly or as a mixture of two or more thereof. Furthermore, aminopolycarboxylic acids may be used singly or as a mixture thereof. Also, in any cases, the aminopolycarboxylic acid may be used in an excess amount to that necessary for forming the ferric ion complex salt.

Also, the bleach solution or the blix solution containing the ferric ion complex salt may further contain a complex salt of a metal ion other than iron, such as cobalt, copper, etc.

Examples of fixing agents which can be used in this invention include thiosulfates such as sodium thiosulfate, ammonium thiosulfate, etc., thiocyanates such as sodium thiocyanate, ammonium thiocyanate, etc., thioether compounds such as ethylenebisthioglycolic acid, 3,6-dithia-1,8-octanediol, etc., and water-soluble silver halide solvents such as thioureas. They can be used singly or as a mixture thereof. Also, a specific blix solution composed of a combination of the fixing agent described in Japanese patent application (OPI) No. 155354/80 and a large amount of a halide such as potasssium iodide can be used in this invention.

In this invention, the use of a thiosulfate, in particular, ammonium thiosulfate is preferred.

The amount of the fixing agent is preferably from about 0.3 mol to about 2 mols, and more preferably from about 0.5 mol to about 1.0 mol, per liter of blix solution.

The pH range of the desilvering solution for use in this invention is preferably from about 4 to about 8.5, and more preferably from about 5 to about 8. If the pH of the blix solution is lower than the aforesaid range, deterioration of the solution and the conversion of cyan dyes into leuco compounds are accelerated, although the desilvering power may be improved. On the other hand, if the pH is higher than the aforesaid range, the desilvering power is lowered and stains are liable to occur.

For controlling the pH of the blix solution, if desired or necessary, hydrochloric acid, sulfuric acid, nitric acid, acetic acid, hydrogencarbonate, ammonia, potassium hydroxide, sodium hydroxide, sodium carbonate, potassium carbonate, etc., may be added to the solution.

The bleach solution, the blix solution, or a prebath thereof may, if necessary, contain various bleach accelerators. Preferred examples of the useful bleach accelerators are compounds having a mercapto group or a disulfide group which have a high acceleration effect, and particularly those described in U.S. Pat. No. 3,893,858, West German Pat. No. 1,290,812, and Japanese patent application (OPI) No. 95630/78.

Furthermore, the desilvering solution for use in this invention may further contain a rehalogenating agent such as a bromide (e.g., potassium bromide, sodium bromide, ammonium bromide, etc.), a chloride (e.g., potassium chloride, sodium chloride, ammonium chloride, etc.), and an iodide (e.g., ammonium iodide, etc.). Furthermore, if desired, the desilvering solution may contain a corrosion inhibitor such as inorganic or organic acids having a pH buffer action of the alkali metal salts and ammonium salts thereof (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), ammonium nitrate, guanidine, etc.

The blix solution and the fix solution for use in this invention contain a sulfite ion releasing compounds such as sulfites (e.g., sodium sulfite, potassium sulfite, ammonium sulfite, etc.), bisulfites (e.g., ammonium bisulfite, sodium bisulfite, potassium bisulfite, etc.), metabisulfites (e.g., potassium metabisulfite, sodium metabisulfite, ammonium metabisulfite, etc.), etc., as a preservative. The compound is contained in the processing solution in an amount of, preferably from about 0.02 to about 0.30 mol, more preferably from about 0.10 to about 0.20 mol (calculated as sulfite ion) per liter of the processing solution. Other preservatives which can be also used in this invention are hydroxylamine, hydrazine, and bisulfite addition product of an aldehyde compound (e.g., acetaldehyde sodium bisulfite).

Also, the desilvering solution may further contain various optical whitening agents, defoaming agents, surface active agents, and organic solvents such as polyvinylpyrrolidone, methanol, etc.

The processing temperature for the desilvering solution in this invention is generally from 10° C. to 50° C., and preferably from 20° C. to 40° C. Also, the amount of the replenisher for the processing solution is from 20 ml to 2,000 ml, and preferably from 30 ml to 1,500 ml, per square meter of the color photographic material.

According to this invention, silver halide color photographic materials are generally subjected to at least one of a water wash step and a stabilization step after the desilvering processing such as fix or blix.

The amount of water used in the water wash step can be selected from a wide range depending upon properties of the photographic material (e.g., a kind of couplers used therein), application of the photographic material, temperature of water, number of tanks for water wash, replenishing manner (e.g., countercurrent system and direct system) and the like. Relationship between the amount of water to be used and the number of tanks for water wash in a multistage countercurrent system can be determined according to the method described in *Journal of the Society of Motion Picture and Television Engineers,* Vol. 64, pp. 248–253 (May, 1955).

The amount of water can be reduced to a great extent by the multistage countercurrent system described in the aforesaid literature. However, as the residence time of water in tank increases, bacteria tends to propagate to produce floating matter in water, which in turn adhere onto the photographic material. In the method for processing color photographic materials of this invention, such a problem can be effectively eliminated by reducing the contents of calcium and magnesium in the water as described in Japanese patent application No. 131632/86. Alternatively, the isothiazolone compounds described in Japanese patent application (OPI) No. 8542/82 and antibacterial agents as described in Hiroshi Horiguchi, *Bokinbobaizai no Kagaku* (*Chemistry of Antibacterial and Antifungal Agents*), *Biseibutsu no Mekkin, Sakkin, Bobai Gijutsu* (*Sterilization and Antifungal Technique of Microorganism*), edited by Eisei Gijutsu Kai, and *Bokinbobaizai Jiten* (*Handbook of Antibacterial and Antifungal Agents*), edited by Nippon Bokinbobai Gakkai, such as thiabendazoles, chlorine type antibacterial agents (e.g., sodium salt of chlorinated isocyanuric acid) and benzotriazoles, can be used.

Further, the color photographic material of this invention can be directly treated with a stabilizing solution without the above-described water wash step in a conventional manner as described, for example, in Japanese patent application (OPI) Nos. 8543/82, 14834/83, and 220345/85. In particular, stabilizing solutions containing 1-hydroxyethylidene-1,1-diphosphonic acid, 5-chloro-2-methyl-4-isothiazoline-3-one, bismuth compounds, ammonium compounds, or the like are preferably used for the purpose.

In the case where the color photographic materials are subjected to the water wash step followed by the stabilization step, a stabilizing bath containing formalin (37 wt% of formaldehyde solution) and a surface active agent, which is generally used as a final bath in processing of color photographic materials for photography, is preferably used.

It is preferred that the water wash and/or stabilization step is performed by a multistage countercurrent system using, for example, from 2 to 4 tanks, to reduce the amount of replenisher. The amount of the replenisher for the wash water or the stabilization solution is preferably from 0.1 to 50 times, more preferably from 0.5 to 50 times, and most preferably from 3 to 30 times the amount of a processing solution carried from the prebath per unit area of the color photographic material. The amount of the processing solution carried from the pre-bath is generally from 20 to 200 ml/m$^2$, preferably from 30 to 100 ml/m$^2$, and more preferably from 30 to 60 ml/m$^2$.

The processing time for the water wash step and/or the stabilization step in this invention means the total time required for the desilvered color photographic material from contacting with the first bath of the water wash and/or stabilization step to reaching drying step (i.e., the entrance of drying zone), and when water wash is performed before or after the stabilization step, the time for the water wash is included in the processing time.

The processing time for the washing, stabilization, or washing and stabilization in this invention differs according to the kind of color photographic materials and the processing conditions therefor, but is usually from 20 seconds to 10 minutes, preferably 20 seconds to 5 minutes, more preferably from 20 seconds to 2 minutes, and particularly preferably from 20 seconds to 1 minute and 30 seconds.

The processing temperature for the water wash or stabilization step in this invention is generally from 20° C. to 45° C., preferably from 25° C. to 40° C., and more preferably from 30° C. to 38° C.

For increasing the washing out effect of components in the photographic layers of a color photographic material during the water wash or stabilization step, it is preferred to perform circulation and stirring of the solution. In this case, it is particularly preferred to employ a method of strongly striking the surface of the emulsion layer of a color photographic material by liquid stream (e.g., gas stirring, liquid spraying, etc.).

In this invention, each processing bath or tank may, if desired, be equipped with a heater, a temperature sensor, a liquid level sensor, a circulation pump, a filter, a floating lid, a squeegee, a nitrogen stirrer, an air stirrer, etc.

Typical examples of the processings steps used in accordance with this invention are illustrated below although the invention is not limited thereto.

(1) Color development-bleach-fix-water wash-stabilization-drying
(2) Color development-bleach-fix-stabilization-drying
(3) Color development-bleach-blix-water wash-stabilization-drying
(4) Color development-bleach-blix-stabilization-drying
(5) Color development-fix-blix-water wash-stabilization-drying
(6) Color development-fix-blix-stabilization-drying (7) Color development-blix-stabilization-drying
(8) Color development-blix-water wash-drying
(9) Color development-blix-water wash-stabilization-drying
(10) Black-and-white development-water wash-light fogging-color development-water wash-blix-water wash-drying
(11) Black-and-white development-water wash-light fogging-color development-blix-stabilization-drying
(12) Black-and-white development-water wash-light fogging-color development-bleach-blix-stabilization-drying
(13) Black-and-white development-waer wash-reversal-color development-acceleration-bleach-fix-water wash-stabilization-drying
(14) Black-and-white development-water wash-reversal-color development-blix-stabilization-drying
(15) Black-and-white development-reversal-color development-bleach-blix-stabilization-drying
(16) Black-and-white development-water wash-reversal-color development-acceleration-blix-stabilization-drying Silve halide color photographic materials which are processed by the method of this invention contain various kinds of couplers.

Useful color couplers are cyan coloring couplers, magenta coloring couplers, and yellow coloring couplers and typical examples of these couplers are naphthol or phenol series compounds for cyan couplers, pyrazolone series compounds for magenta couplers, and closed chain or heterocyclic ketomethylene series compounds for yellow couplers. Specific examples of these cyan, magenta, and yellow couplers which can be used in this invention are described in the patents cited in *Research Disclosure,* RD No. 17643 (December, 1978), VII-D and ibid., RD No. 18717 (November, 1979).

It is preferred that the color couplers existing in the color photographic materials in this invention have diffusion resistance or no-diffusibility by having a ballast group or by being polymerized.

As for the color couplers, four-equivalent color couplers having a hydrogen atom at the coupling active position, and two-equivalent color couplers having a releasable group at the coupling active position can be used, and the amount of silver can be reduced in the case of using the two-equivalent color couplers.

Couplers providing colored dyes having a proper diffusibility, non-coloring couplers, DIR couplers releasing a development inhibitor with the coupling reaction, or couplers releasing a development accelerator with the coupling reaction can be also used in this invention.

With respect to yellow couplers which can be used in this invention, oil protected type acylacetamide series couplers are typical examples. Specific examples of these couplers are described in U.S. Pat. Nos. 2,407,210, 2,875,057, and 3,265,506. In this invention, the use of two-equivalent yellow couplers is preferred, and examples of two-equivalent yellow couplers include oxygen atom-releasing type yellow couplers described in U.S. Pat. Nos. 3,408,194, 3,447,928, 3,933,501 and 4,022,620 and nitrogen atom-releasing type yellow couplers described in Japanese Patent Publication No. 10739/83, U.S. Pat. Nos. 4,401,752 and 4,326,024, RD. No. 18053 (April 1979), British Pat. No. 1,425,020, West German patent application (OLS or Offenlegungsshrift) Nos. 2,219,917, 2,261,361, 2,329,587, and 2,433,812. In these couplers, α-pivaloylacetanilide couplers are excellent in the fastness, in particular, light fastness, of the colored dyes formed therefrom. On the other hand, α-benzoylacetanilide series couplers give high coloring density.

As magenta couplers which can be used in this invention, there are indazolone series and cyaoacetyl series couplers, and preferably 5-pyrazolone series and pyrazoloazole series couplers.

As 5-pyrazolone series couplers, the couplers having an arylamino group or an acylamino group at the 3-position thereof are preferred from the viewpoint of the hue and coloring density of colored dyes produced therefrom, and specific examples thereof are described in U.S. Pat. Nos. 2,311,082, 2,343,703, 2,600,788, 2,908,573, 3,062,653, 3,152,896, and 3,936,015. Preferred examples of the releasable groups for the two-equivalent 5-pyrazolone series couplers are nitrogen atom-releasing groups described in U.S. Pat. No. 4,310,619 and arylthio groups described in U.S. Pat. No. 4,351,897. Also, 5-pyrazolone series couplers having a ballast group described in European Pat. No. 73,636 give high coloring density.

As pyrazoloazole series magenta couplers, pyrazolotriazole series couplers are most preferred. The compounds described in Japanese Patent Publication No. 27411/72 and Japanese patent application (OPI) Nos. 171956/84 and 172982/85 are also preferably used.

As cyan couplers which can be used in this invention, there are oil-protected type naphtholic and phenolic couplers.

The naphtholic cyan couplers include naphtholic couplers described in U.S. Pat. No. 2,474,293, and preferably oxygen atom-releasing type 2-equivalent naphtholic couplers described in U.S. Pat. Nos. 4,052,212, 4,146,396, 4,228,233 and 4,296,200. Also, specific examples of the phenolic cyan couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group of two or more carbon atoms at the meta-position of the phenol nucleus described in U.S. Pat. No. 3,772,002, 2,5-diacylamino-substituted phenolic cyan couplers described in U.S. Pat. Nos. 2,772,162, 3,758,308, 4,126,396, 4,334,011 and 4,327,173, West German Patent Application (OLS) No. 3,329,729, Japanese Patent Application (OPI) No. 166956/84, etc., and phenolic cyan couplers having a phenylureido group at the 2-position and an acylamino group at the 5-position thereof described in U.S. Pat. Nos. 3,446,662, 4,333,999, 4,451,559, 4,427,767, etc.

Color couplers giving a colored dye having a proper diffusibility can be also used together with the aforesaid couplers of this invention. Specific examples of such couplers are described in U.S. Pat. No. 4,366,237 and British Pat. No. 2,125,570 with respect to magnetic couplers and also in European Pat. No. 96,570 and West German Patent Application (OLS) No. 3,234,533 with respect to yellow, magenta, and cyan couplers.

The dye-forming couplers and specific couplers described above may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The couplers for use in this invention can be used for one photographic layer as a mixture of two or more for meeting the properties required for a particular color photographic material, or the same kind of coupler may be incorporated to two or more photographic layers.

The couplers for use in this invention can be introduced into the color photographic material by various dispersion methods. For example, there are a solid dispersion method, an alkali dispersion method, preferably a latex dispersion method, and more preferably an oil drop-in-water dispersion method. In the oil drop-in-water dispersion method, a coupler is dissolved in one or both of a high-boiling point organic solvent having boiling point of at least 175° C. and a so-called auxiliary solvent, which is a low-boiling point organic solvent, and thereafter, the solution is finely dispersed in an aqueous medium such as water and an aqueous gelatin solution in the existence of a surface active agent. Examples of the high-boiling point organic solvent are described in U.S. Pat. No. 2,322,027, etc. In this case, the coupler may be dispersed with phase inversion, and also, if necessary, the auxiliary solvent may be removed by distillation, noodle washing, or ultrafiltration before coating the dispersion.

A standard amount of the color coupler is in the range of from 0.001 mol to 1 mol per mol of the light-sensitive silver halide in the silver halide emulsion layer, and a preferred amount is from 0.01 to 0.5 mol for a yellow coupler, from 0.003 mol to 0.3 mol for a magenta coupler, and from 0.002 mol to 0.3 mol for a cyan coupler, per mol of the light-sensitive silver halide.

The silver halide emulsion for use in this invention contains silver iodide, silver iodobromide, silver bromide, silver chlorobromide, silver chloride, etc., and a preferred silver halide is silver chloride, silver iodobromide, and silver chlorobromide.

The silver halide grains for use in this invention may have different phase between the inside and the surface layer thereof, may be a multiphase structure having a junction structure, or may be composed of a uniform phase throughout the whole grain. Also, the silver halide grains may be composed of a mixture thereof.

The mean grain size (shown by the diameter of the grains when the grain is spherical or similar to spherical, and shown by the mean value based on the projected area using, in the case of cubic grains, edge length as the grain size) of the silver halide grains for use in this invention is preferably in the range of from 0.1 μm to 2 μm, and more preferably from 0.15 μm to 1 μm. The grain size distribution of the silver halide grains may be narrow or broad, but the use of a so-called monodisperse silver halide emulsion, wherein the value (coefficient of variation) obtained by dividing the standard deviation in the grain size distribution curve of the silver halide emulsion by the mean grain size of the silver halide grains in the emulsion is within 20%, and particularly within 15%, is preferred. Also, for satisfying the desired gradation for the color photographic material, two or more kinds of monodisperse silver halide emulsions (preferably having the above-described coefficient of variation) each having different grain size can be used as a mixture thereof for one emulsion layer or as separate emulsion layers each having substantially the same color sensitivity. Furthermore, two or more kinds of polydisperse silver halide emulsion layers or a combination of the monodisperse silver halide emulsion and a polydisperse silver halide emulsion can be used as a mixture thereof for one emulsion layer or as separate emulsion layer.

The silver halide grains for use in this invention may have a regular crystal form such as cubic, octahedral, dodecahedral, tetradecahedral, etc., a mixture thereof, an irregular crystal form such as spherical, etc., or a composite form of these crystal forms. Also, the silver halide grains may be tabular grains and in this case, a tabular grain silver halide emulsion wherein tabular silver halide grains having an aspect ratio (length/thickness) of at least 5/1, and preferably at least 8/1, account for at least 50% of the total projected area of the silver halide grains can be used in this invention. A mixture of these silver halide emulsions each containing silver halide grains having different crystal form may also be used. The silver halide emulsion may be of a surface latent image type forming latent images mainly on the surface thereof, or an internal latent image forming latent images mainly in the inside of the grains.

The silver halide photographic emulsions for use in this invention can be prepared according to the methods described in P. Grafkides, *Chimie et Physique Photographique,* published by Paul Montel, 1967; G. F. Duffin, *Photographic Emulsion Chemistry,* published by Focal Press, 1966; and V. L. Zelikman et al, *Making and Coating Photographic Emulsion,* published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the presence of excess silver ions can also be used. As one system of the double jet method, a so-called controlled double jet method of keeping a constant pAg in a liquid phase of forming silver halide grains can also be used. According to this method, a silver halide emulsion containing silver halide grains having a regular crystal form and substantially uniform grain sizes can be obtained.

Furthermore, a silver halide emulsion prepared by a conversion method including a step of converting a silver halide already formed before finishing the formation of the silver halide grains into a silver halide having small solubility product or a silver halide emulsion to which the similar halogen conversion is applied after finishing the formation of the silver halide grains can also be used in this invention.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may be present in the system.

Silver halide emulsion are, after the formation of the silver halide grains, usually physically ripened, desalted, and chemically ripened before coating.

A silver halide solvent (e.g., ammonia, potassium rhodanate, and thioethers and thione compounds described in U.S. Pat. No. 3,271,157, Japanese Patent Application (OPI) Nos. 12360/76, 82408/78, 144319/78, 100717/79, 155828/79, etc.) can be used for the precipitation, physical ripening, and chemical ripening of the silver halide emulsions for use in this invention.

For removing soluble salts from silver halide emulsion after physical ripening, a noodle washing method, a flocculation method, or an ultrafiltration method can be employed.

The silver halide emulsion for use in this invention can be chemically sensitized by a sulfur sensitization method using active gelatin or a sulfur-containing compound capable of reacting with silver (e.g., thiosulfates, thiourea, mercapto compounds, rhodanines, etc.); a reduction sensitization method using a reducing material (e.g., stannous salts, amines, hydrazine derivatives, formamidinesulfinic acids, silane compounds, etc.); a noble metal sensitization method using a metal compound (e.g., gold complex salts and complex salt of metals belonging to group VIII of the Periodic Table, such as Pt, Ir, Pd, Rh, Fe, etc.), or a combination thereof.

The silver halide emulsions for use in this invention are spectrally sensitized by methine dyes, etc., so that the emulsion have desired color sensitivities, i.e., blue sensitivity, green sensitivity, and red sensitivity. The dyes for use include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes, and complex merocyanine dyes. For these dyes, nuclei ordinary utilized in cyanine dyes are useful as basic heterocyclic nuclei.

These sensitizing dyes may be used singly or as a combination thereof. A combination of sensitizing dyes is frequently used for the purpose of super color sensitization.

The silver halide emulsion for use in this invention may contain a dye having no spectral sensitizing activity by itself or a material which does not substantially absorb visible light and shows super color sensitizing activity, together with the sensitizing dye(s).

The color photographic materials for use in this invention may further contain hydroquinone derivatives, aminophenol derivatives, amines, gallic acid derivatives, catechol derivatives, ascorbic acid derivatives, non-coloring couplers, sulfonamidophenol derivatives, etc., as color for preventing agents or color mixing preventing agents.

Also, the color photographic materials for use in this invention can further contain fading preventing agents. Typical examples of organic fading preventing agents are hydroquinones, 6-hydrochromans, 5-hydroxycoumarans, spirochromans, p-alkoxyphenols, bisphenols, hindered phenols, gallic acid derivatives, methylenedioxybenzenes, aminophenols, hindered amines and the ether or ester derivatives of the aforesaid compounds obtained by silylating or alkylating the phenolic hydroxy group of these compounds. Also, metal complexes such as (bissalicylaldoxymate) nickel complex salt and (bis-N,N-dialkyldithiocarbamate) nickel complex salt can be used as the fading preventing agent.

For preventing the deterioration of yellow dye images by heat, moisture, and light, compounds having both moieties of hindered amine and hindred phenol in one molecule, as described in U.S. Pat. No. 4,268,593, give good results. Also, for preventing the deterioration of magenta dye images, particularly by light, spiroindans described in Japanese Patent Application (OPI) No. 159644/81 and chromans substituted by hydroquinone diether or hydroquinone monoether described in Japanese Patent Application (OPI) No. 89835/80 give preferred results.

For improving the storage stability, in particular, the light fastness of cyan dye images, it is preferred to use a benzotriazole series ultraviolet absorbent with the cyan coupler(s). The ultraviolet absorbent may be coemulsified with the cyan coupler(s).

The amount of the ultraviolet absorbent is desirably sufficient for imparting light stability to cyan dye images, but since if the amount is too much, the unexposed portions (background portions) of the color photographic material are sometimes yellowed, the amount thereof is usually selected in the range of from $1\times10^{-4}$ mol/m$^2$ to $2\times10^{-3}$ mol/m$^2$, particularly from $5\times10^{-4}$ mol/m$^2$ to $1.5\times10^{-3}$ mol/m$^2$.

In the layer structure of an ordinary color photographic paper, the ultraviolet absorbent(s) are incorporated in one or both layers adjacent to both sides of a red-sensitive silver halide emulsion layer containing cyan coupler. When the ultraviolet absorbent(s) are incorporated in the interlayer between a green-sensitive emulsion layer and a red-sensitive emulsion layer, the ultraviolet absorbent(s) may be emulsified together with a color mixing preventing agent. When the ultraviolet absorbent(s) are incorporated in a protective layer, another protective layer may be formed on the protective layer as the outermost layer. The outermost protective layer may contain a matting agent having a proper particle size.

The color photographic materials for use in this invention may contain ultraviolet absorbent(s) in the hydrophilic colloid layer(s) thereof.

The color photographic materials for use in this invention may further contain water-soluble dyes in the hydrophilic colloid layers as filter dyes or for the purpose of irradiation prevention or halation prevention.

The color photographic materials may further contain whitening agents such as stilbene series, triazine series, oxazole series, or coumarin series whitening agents in the photographic emulsion layers or other hydrophilic colloid layers. The whitening agent may be water-soluble or a water-insoluble whitening agent may be used as the form of the dispersion thereof.

The color photographic material for use in this invention preferably has on a transparent support or a reflective support auxiliary layers such as protective layers(s), interlayers, a filter layer, an antihalation layer, a back layer, etc., in addition to the silver halide emulsion layers.

As a binder or protective colloid which can be used for the emulsion layers and auxiliary layers of the color photographic materials for use in this invention, gelatin is advantageously used, but other hydrophilic colloids can also be used.

The color photographic materials for use in this invention may further contain various stabilizers, stain preventing agents, developing agents or the precursors therefor, development accelerators or the precursors therefor, lubricants, mordants, matting agents, antistatic agents, plasticizers, or other photographically useful additives in addition to the above-described additives. Typical examples of such additives are described in RD No. 17643 (December, 1978) and ibid., No. 18716 (November, 1979).

The "reflective support" for the color photographic material which is processed in this invention is a support having high reflectivity for clearly viewing color images forming in silver halide emulsion layer(s) and includes a support coated with a hydrophobic resin having dispersed therein a light reflective maerial such as titanium oxide, zinc oxide, calcium carbonate, calcium sulfate, etc., and a support composed of a hydrophobic resin containing therein the light reflective material as described above as a dispersion thereof. Examples of such a support include baryta-coated papers, polyethylene-coated papers, polypropylene series synthetic papers, and transparent supports coated with a reflective layer or containing therein a reflective material as described above. Examples of such a transparent support are glass plates, polyester films (e.g., polyethylene terephthalate films, cellulose triacetate films, cellulose nitrate films, etc.), polyamide films, polycarbonate films, polystyrene films, etc. These supports can be appropriately selected according to the intended purpose.

The following examples are intended to illustrate this invention more specifically, but not to limit it any way.

EXAMPLE 1

A multilayer color photographic paper having the layer structure shown below on a paper support both surfaces of which were coated with polyethylene was prepared. In this case, the polyethylene coating on the emulsion layer-carrying side of the support contained titanium dioxide as a white pigment and ultramarine blue as a bluish dye.

The coating compositions for the layers were prepared as follows.

Coating Composition for Layer 1:

In 27.2 ml of ethyl acetate and 7.9 g of solvent (c) were dissolved 19.1 g of yellow coupler (a) and 4.4 g of color image stabilizer (b), and the solution thus obtained was dispersed by emulsification in 185 ml of an aqueous 10% gelatin solution containing 8 ml of 10% sodium dodecylbenzenesulfonate. On the other hand, 90 g of a blue-sensitive silver halide emulsion was prepared by adding a blue-sensitive dye shown below to a silver chlorobromide emulsion (silver bromide 1.0 mol%, silver 70 g/kg) in an amount of $5.0\times10^{-4}$ mol per mol of silver chlorobromide in the emulsion. The emulsified dispersion of the coupler described above was mixed with the aforesaid silver halide emulsion and the concentration of gelatin was adjusted as shown below for Layer 1 to provide the coating composition for Layer 1.

The coating compositions for Layer 2 to Layer 7 were also prepared in a manner similar to the aforesaid coating composition for Layer 1.

In this example, 1-oxy-3,5-dichloro-s-triazine sodium salt was used for each layer as a gelatin hardening agent.

As spectral sensitizers for the silver halide emulsion layers of the sample, the following compounds were used.

For the blue-sensitive emulsion layer:

For the blue-sensitive emulsion layer:

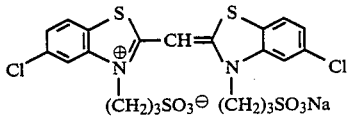

($5.0\times10^{-4}$ mol per mol of silver halide)

For the green-sensitive emulsion layer:

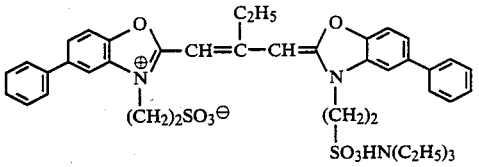

($4.0\times10^{-4}$ mol per mol of silver halide)

and

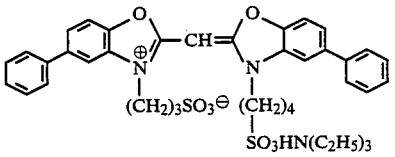

($7.0\times10^{-4}$ mol per mol of silver halide)

For the red-sensitive emulsion layer:

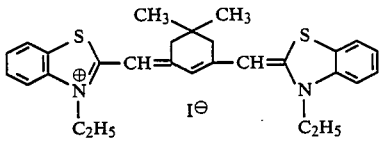

($1.0\times10^{-4}$ mol per mol of silver halide)

Also, as irradiation preventing dyes for the silver halide emulsions, the following dyes were used.

For the green-sensitive emulsion layer:

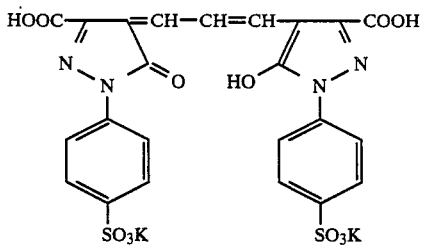

For the red-sensitive emulsion layer:

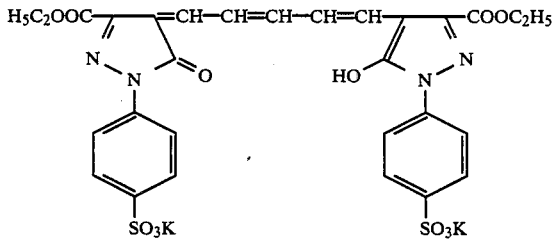

The layer structure of the sample thus prepared was as follows:

Layer 1: Blue-Sensitive Emulsion Layer

Silver Chlorobromide Emulsion (silver bromide 1.0 mol%): 0.30 g/m$^2$ as silver
Gelatin: 1.86 g/m$^2$
Yellow Coupler (a): 0.82 g/m$^2$
Color Image Stabilizer (b): 0.19 g/m$^2$
Solvent (c): 0.34 ml/m$^2$ Layer 2: Color Mixing Preventing Layer Gelatin: 0.99 g/m$^2$
Color Mixing Preventing Agent (d): 0.08 g/m$^2$ Layer 3: Green-Sensitive Emulsion Layer Silver Chlorobromide Emulsion (silver bromide 0.5 mol%): 0.16 g/m$^2$ as silver
Gelatin: 1.80 g/m$^2$
Magenta Coupler (e): 0.34 g/m$^2$
Color Image Stabilizer (f): 0.20 g/m$^2$
Solvent (g): 0.68 ml/m$^2$ Layer 4: Ultraviolet Absorbing Layer Gelatin: 1.60 g/m$^2$
Ultraviolet Absorbent (h): 0.62 g/m$^2$
Color Mixing Preventing Agent (d): 0.05 g/m$^2$
Solvent (i) 0.25 ml/m$^2$ Layer 5: Red-Sensitive Emulsion Layer Silver Chlorobromide Emulsion (silver bromide 1.0 mol%): 0.26 g/m$^2$ as silver
Gelatin: 0.98 g/m$^2$
Cyan Coupler (j): 0.38 g/m$^2$
Color Image Stabilizer (k): 0.17 g/m$^2$
Solvent (l): 0.23 ml/m$^2$ Layer 6: Ultraviolet Absorbing Layer Gelatin: 0.54 g/m$^2$
Ultraviolet Absorbent (h): 0.21 g/m$^2$
Solvent (i): 0.09 ml/m$^2$ Layer 7: Protective Layer Gelatin: 1.33 g/m$^2$
Acryl-modified copolymer of polyvinyl alcohol (modified degree 17%): 0.17 g/m$^2$ The structural formulae of the compounds used above are as follows.

(a) Yellow Coupler

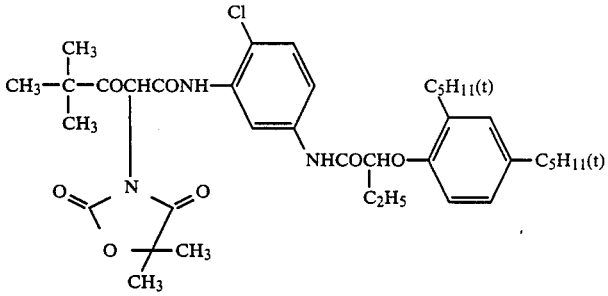

(b) Color Image Stabilizer

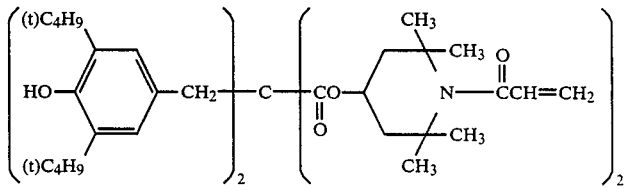

(c) Solvent

-continued
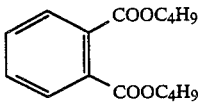
(d) Color Mixing Preventing Agent
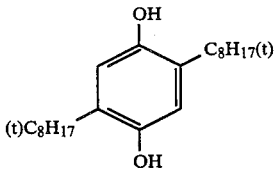
(e) Magenta Coupler
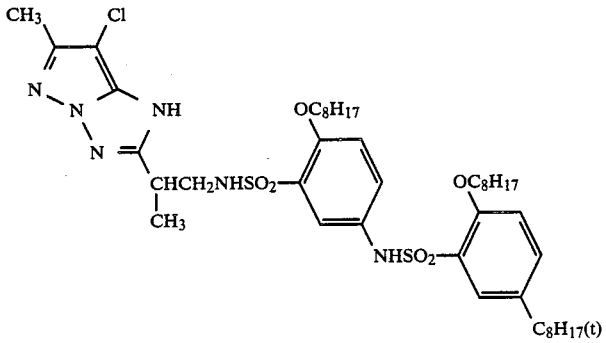
(f) Color Image Stabilizer
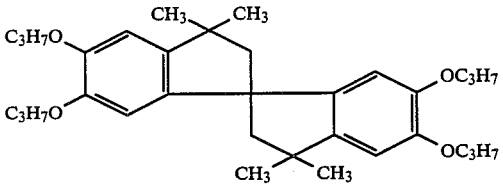
(g) Solvent
Mixture (2/1 by weight of) $(C_8H_{17}O)_3P{=}O$ and (
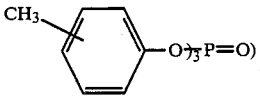
(h) Ultraviolet Absorbent
Mixture (1/5/3 by mol) of
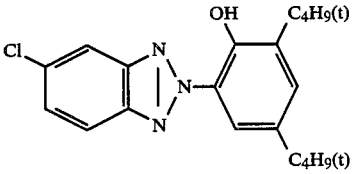
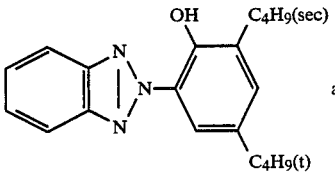
and
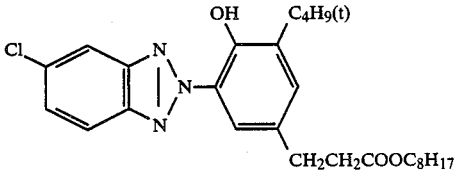
(i) Solvent
$(iso\text{-}C_9H_{18}O)_3P{=}O$
(j) Cyan Coupler -continued Mixture (1/1 by mol) of

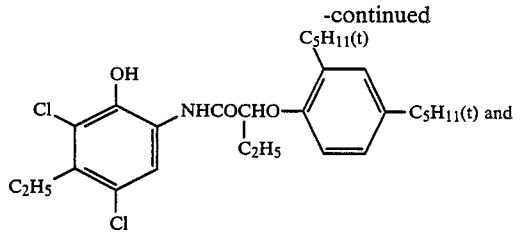

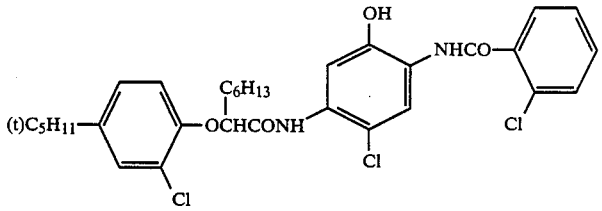

(k) Color Image Stabilizer

Mixture (1/3/3 by mol) of

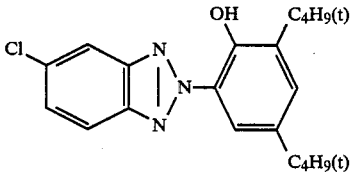

and

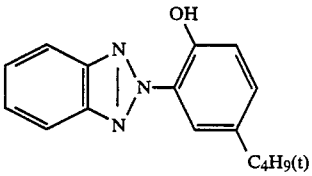

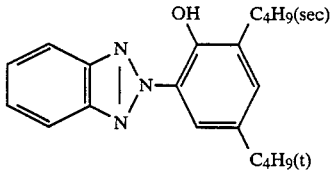

(l) Solvent

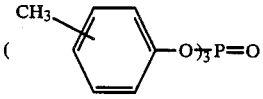

The multilayer color photographic paper thus prepared was imagewise exposed and then continuously processed by the following processing steps until a replenisher for the color developer was supplied up to 3 times the volume of the developer tank.

| Processing Step | Time* | Temperature |
|---|---|---|
| Color Development | 45 sec. | 35° C. |
| Blix | 45 sec. | 35° C. |
| Water Wash (1) | shown in Table 1 below | 35° C. |
| Water Wash (2) | shown in Table 1 below | 35° C. |
| Water Wash (3) | shown in Table 1 below | 35° C. |
| Drying | 60 sec. | 80° C. |

The composition of the color developer was as follows.

| Color Developer | For Tank | Replenisher |
|---|---|---|
| Water | 800 ml | 800 ml |
| Chelating Agent | Shown in Table 1 | |
| Benzyl Alcohol | Shown in Table 1 | |
| Diethylene Glycol | Shown in Table 1 | |
| Triethanolamine | 10 ml | 10 ml |
| Sodium Sulfite | 0.2 g | 0.5 g |
| Sodium Chloride | 0.5 g | — |
| Potassium Carbonate | 30.0 g | 25.0 g |
| N—Ethyl-N—(β-methanesulfonamidoethyl)-3-methyl-4-aminoaniline Sulfate | 5.5 g | 7.5 g |
| Hydroxylamine Sulfate | 2.0 g | 3.5 g |
| Optical Whitening Agent (stilbene series) | 2.0 g | 3.5 g |
| Water to make | 1 liter | 1 liter |
| pH adjusted to KOH | 10.20 | 10.60 |

The composition of the blix solution used above was as follows:

| Blix Solution | For Tank | Replenisher |
|---|---|---|
| Water | 400 ml | 400 ml |
| Ammonium Thiosulfate (70%) | 150 ml | 300 ml |
| Sodium Sulfite | 18 g | 36 g |
| Ethylenediaminetetraacetic Acid Iron (III) Ammonium | 55 g | 110 g |
| Ethylenediaminetetraacetic Acid | 5 g | 10 g |
| Water to make | 1 liter | 1 liter |
| pH adjusted to | 5.75 | 5.30 |

(*Including the time for being moved between tanks) The washing was performed in the three-stage countercurrent system from the Water Wash (3) to Water Wash (1).

The wash water used above was prepared by passing tap water through a mixed-bed type column filled with an H-type strongly acidic cation exchange resin (Diaion SK-1B, produced by Mitsubishi Chemical Industries Ltd.) and an OH-type strongly basic anion exchange resin (Diaion SA-10A, produced by Mitsubishi Chemical Industries Ltd.) to obtain water containing 1.1 mg/liter of calcium ion and 0.5 mg/liter of magnesium ion and having a pH of 6.9, and adding to the water 20 mg/liter of sodium dichloroisocyanurate as a antibacterial agent.

The amount of the replenishers for the color developer, the blix solution, and the wash water were 160 ml, 60 ml, and 200 ml, respectively, per square meter of the color photographic paper. The amount of the processing solution carried from the blix step to the water wash step was about 30 ml per square meter of the color photographic paper.

In each continuous processing, Dmin of each of the blue-sensitive emulsion layer (BL), the green-sensitive emulsion layer (GL), and the red-sensitive emulsion layer (RL) at the start was measured, and also each Dmin at the end of the running test was also measured, whereby the change of each Dmin was determined. The results obtained are shown in Table 1 below.

TABLE 1

| No. | Total Washing Time | Benzyl alcohol (ml/liter)/ diethylene glycol (ml/liter) Tank | Replenisher | Chelating Agent (g/liter) | ΔDmin BL | GL | RL |
|---|---|---|---|---|---|---|---|
| 1 | 3 min 00 sec | 15/10 | 19/15 | — | +0.01 | 0 | 0 |
| 2 | 2 min 30 sec | " | " | — | +0.02 | +0.01 | 0 |
| 3 | 2 min 00 sec | " | " | — | +0.07 | +0.04 | +0.02 |
| 4 | 1 min 00 sec | " | " | — | +0.10 | +0.06 | +0.04 |
| 5 | 2 min 00 sec | " | " | 1,2-Cyclohexanediamine-tetraacetic acid 0.5 | +0.06 | +0.03 | +0.02 |
| 6 | 1 min 00 sec | " | " | 1,2-Cyclohexanediamine-tetraacetic acid 0.5 | +0.09 | +0.05 | +0.03 |
| 7 | 2 min 00 sec | — | — | — | +0.06 | +0.02 | +0.01 |
| 8 | 1 min 00 sec | — | — | — | +0.09 | +0.04 | +0.02 |
| 9 | 2 min 00 sec | 5/10 | 9/15 | — | +0.06 | +0.03 | +0.01 |
| 10 | 1 min 00 sec | " | " | — | +0.09 | +0.05 | +0.03 |
| 11 | 2 min 00 sec | " | " | 1,2-Cyclohexanediamine-tetraacetic acid 0.5 | +0.05 | +0.02 | +0.01 |
| 12 | 1 min 00 sec | " | " | 1,2-Cyclohexanediamine-tetraacetic acid 0.5 | +0.08 | +0.04 | +0.02 |
| 13 | 2 min 00 sec | — | — | 1,2-Cyclohexanediamine-tetraacetic acid | 0 | 0 | 0 |
| 14 | 1 min 00 sec | — | — | 1,2-Cyclohexanediamine-tetraacetic acid | 0 | 0 | 0 |
| 15 | 1 min 00 sec | — | — | 1,2-Cyclohexanediamine-tetraacetic acid | +0.01 | 0 | 0 |
| 16 | 2 min 00 sec | — | — | Diethylenetiraminepenta-acetic acid 0.5 | +0.06 | +0.01 | +0.01 |
| 17 | 2 min 00 sec | — | — | Nitrilotriacetic acid 0.5 | +0.08 | +0.03 | +0.02 |
| 18 | 2 min 00 sec | — | — | 1-Hydroxyethylidene-1,1-diphosphonic acid 0.5 | +0.05 | +0.01 | +0.01 |

Nos. 1–12 and 16–18: comparison examples
Nos. 13–15: examples of this invention

According to the results shown in Table 1 above, the formation of yellow stain is particularly high in the presence of benzyl alcohol, and is severe when the washing time is less than 2 minutes (Nos. 3, 4, 9, and 10). In the aforesaid state, the formation of the stain is scarcely improved by the addition of cyclohexanetetraacetic acid (Nos. 5, 6, 11, and 12). Also, the formation of the stain is scarcely improved by only omitting benzyl alcohol (Nos. 7 and 8). On the other hand, when the chelating compounds in this invention are added in the absence of benzyl alcohol, remarkable prevention of the formation of stain is obtained (Nos. 1, 14, and 15). Also, in the case of using other chelating agents than those in this invention, the formation of the stain is scarcely improved (Nos. 16, 17, and 18).

EXAMPLE 2

A multilayer color photographic material having the layer structure shown below on a cellulose triacetate film support having subbing layer was prepared.

Layer 1: Antihalation Layer

Black Colloid Silver: 0.4 g/m$^2$ as silver
Gelatin: 1.3 g/m$^2$
Colored Coupler C-1: 0.06 g/m$^2$
Ultraviolet Absorbent UV-1: 0.1 g/m$^2$
Ultraviolet Absorbent UV-2: 0.2 g/m$^2$
Dispersion Oil Oil-1: 0.01 g/m$^2$
Dispersion Oil Oil-2: 0.01 g/m$^2$

Layer 2: Interlayer

Fine Grain Silver Bromide (mean grain size 0.07 μm): 0.15 g/m$^2$ as silver
Gelatin: 1.0 g/m$^2$
Colored Coupler C-2: 0.02 g/m$^2$
Dispersion Oil Oil-1: 0.1 g/m$^2$

Layer 3: 1st Red-Sensitive Emulsion Layer

Silver Iodobromide Emulsion (silver iodide 6 mol%, aspect ratio 2.5, mean grain size 0.3 μm): 1.5 g/m$^2$ as silver
Gelatin: 0.6 g/m$^2$
Sensitizing Dye I: $1.0\times10^{-4}$ mol per mol of silver halide
Sensitizing Dye II: $3.0\times10^{-4}$ mol per mol of silver halide
Sensitizing Dye III: $1.0\times10^{-5}$ mol per mol of silver halide
Coupler C-3: 0.06 g/m$^2$
Coupler C-4: 0.06 g/m$^2$
Coupler C-8: 0.04 g/m$^2$
Coupler C-2: 0.03 g/m$^2$
Dispersion Oil Oil-1: 0.03 g/m$^2$
Dispersion Oil Oil-3: 0.012 g/m$^2$ Layer 4: 2nd Red-Sensitive Emulsion Layer Silver Iodobromide Emulsion (silver iodide 6 mol%, aspect ratio 3.5, mean grain size 0.5 μm): 1.5 g/m² as silver
Sensitizing Dye I: $1.0\times10^{-4}$ mol per mol of silver halide
Sensitizing Dye II: $3.0\times10^{-4}$ mol per mol of silver halide
Sensitizing Dye III: $1.0\times10^{-5}$ mol per mol of silver halide
Coupler C-3: 0.24 g/m²
Coupler C-4: 0.24 g/m²
Coupler C-8: 0.04 g/m²
Coupler C-2: 0.04 g/m²
Dispersion Oil Oil-1: 0.15 g/m²
Dispersion Oil Oil-3: 0.02 g/m²

Layer 5: 3rd Red-Sensitive Emulsion Layer

Silver Iodobromide Emulsion (silver iodide 10 mol %, aspect ratio 1.5, mean grain size 0.7 μm): 2.0 g/m² as silver
Gelatin: 1.0 g/m²
Sensitizing Dye I: $1\times10^{-4}$ mol per mol of silver halide
Sensitizing Dye II: $3\times10^{-4}$ mol per mol of silver halide
Sensitizing Dye III: $1\times10^{-5}$ mol per mol of silver halide
Coupler C-6: 0.05 g/m²
Coupler C-7: 0.1 g/m²
Dispersion Oil Oil-1: 0.01 g/m²
Dispersion Oil Oil-2: 0.05 g/m²

Layer 6: Interlayer

Gelatin: 1.0 g/m²
Compound Cpd-A: 0.03 g/m²
Dispersion Oil Oil-1: 0.05 g/m²

Layer 7: 1st Green-Sensitive Emulsion Layer

Silver Iodobromide Emulsion (silver iodide 6 mol%, aspect ratio 2.5, mean grain size 0.3 μm): 0.7 g/m² as silver
Sensitizing Dye IV: $5\times10^{-4}$ mol per mol of silver halide
Sensitizing Dye VI: $0.3\times10^{-4}$ mol per mol of silver halide
Sensitizing Dye V: $2\times10^{-4}$ mol per mol of silver halide
Gelatin: 1.0 g/m²
Coupler C-9: 0.2 g/m²
Coupler C-5: 0.03 g/m²
Coupler C-1: 0.03 g/m²
Dispersion Oil Oil-1: 0.5 g/m²

Layer 8: 2nd Green-Sensitive Emulsion Layer

Silver Iodobromide Emulsion (silver iodide 5 mol%, aspect ratio 3.5, mean grain size 0.5 μm): 1.4 g/m² as silver
Sensitizing Dye IV: $5\times10^{-4}$ mol per mol of silver halide
Sensitizing Dye V: $2\times10^{-4}$ mol per mol of silver halide
Sensitizing Dye VI: $0.3\times10^{-4}$ mol per mol of silver halide
Coupler C-9: 0.25 g/m²
Coupler C-1: 0.03 g/m²
Coupler C-10: 0.015 g/m²
Coupler C-5: 0.01 g/m²
Dispersion Oil Oil-1: 0.2 g/m²

Layer 9: 3rd Green-Sensitive Emulsion Layer

Silver Iodobromide Emulsion (silver iodide 10 mol%, aspect ratio 1.5, mean grain size 0.7 μm). 1.9 g/m² as silver
Gelatin: 1.0 g/m²
Sensitizing Dye VII: $3.5\times10^{-4}$ mol per mol of silver halide
Sensitizing Dye VIII: $1.4\times10^{-4}$ mol per mol of silver halide
Coupler C-11: 0.01 g/m²
Coupler C-12: 0.03 g/m²
Coupler C-13: 0.20 g/m²
Coupler C-1: 0.02 g/m²
Coupler C-15: 0.02 g/m²
Dispersion Oil Oil-1: 0.20 g/m²
Dispersion Oil Oil-2: 0.05 g/m²

Layer 10: Yellow Filter Layer

Gelatin: 1.2 g/m²
Yellow Colloid Silver: 0.16 g/m² as silver
Compound Cpd-B: 0.1 g/m²
Dispersion Oil Oil-1: 0.3 g/m²

Layer 11: 1st Blue-Sensitive Emulsion Layer

Monodispersion Silver Iodobromide Emulsion (silver iodide 6 mol%, aspect ratio 1.5, mean grain size 0.3 μm): 1.0 g/m² as silver
Gelatin: 1.0 g/m²
Sensitizing Dye IX: $2\times10^{-4}$ mol per mol of silver halide
Coupler C-14: 0.9 g/m²
Coupler C-5: 0.07 g/m²
Dispersion Oil Oil-1: 0.2 g/m²

Layer 12: 2nd Blue-Sensitive Emulsion Layer

Silver Iodobromide Emulsion (silver iodide 10 mol%, aspect ratio 1.5, mean grain size 1.5 μm): 0.9 g/m² as silver
Gelatin: 0.6 g/m²
Sensitizing Dye IX: $1\times10^{-4}$ mol per mol of silver halide
Coupler C-14: 0.25 g/m²
Dispersion Oil Oil-1: 0.07 g/m²

Layer 13: 1st Protective Layer

Gelatin: 0.8 g/m²
Ultraviolet Absorbent UV-1: 0.1 g/m²
Ultraviolet Absorbent UV-2: 0.2 g/m²
Dispersion Oil Oil-1: 0.01 g/m²
Dispersion Oil Oil-2: 0.01 g/m²

Layer 14: 2nd Protective Layer

Fine Grain Silver Bromide (mean grain size 0.07 μm): 0.5 g/m² as silver
Gelatin: 0.45 g/m²
Polymethyl Methacrylate Particles (diameter 1.5 μm): 0.2 g/m²
Hardening Agent H-1: 0.4 g/m²
Formaldehyde Scavenger S-1: 0.5 g/m²
Formaldehyde Scavenger S-2: 0.5 g/m²

Each layer described above further contained a surface active agent as a coating aid.

The chemical structures of the compounds used above are as follows.

-continued
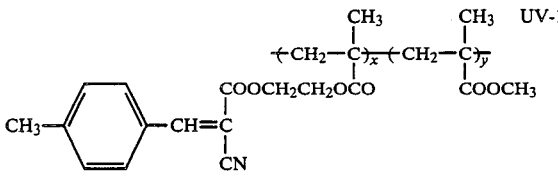
x/y = 7/3 (by weight) UV-1
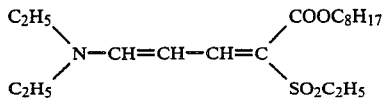
UV-2
Tricresyl Phosphate Oil-1
Dibutyl Phthalate Oil-2
Bis(2-ethylhexyl)Phthalate Oil-3
C-1
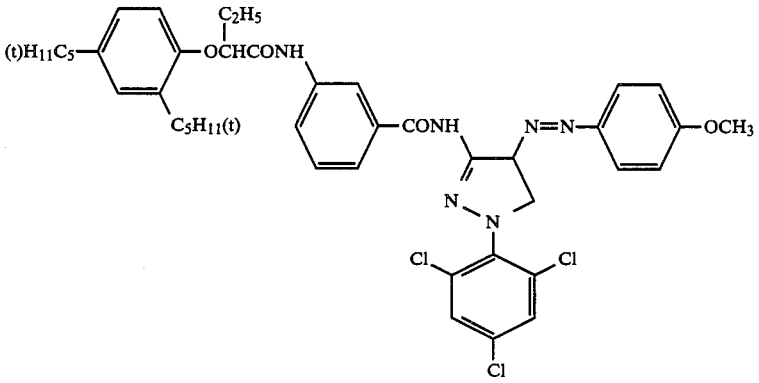
C-2
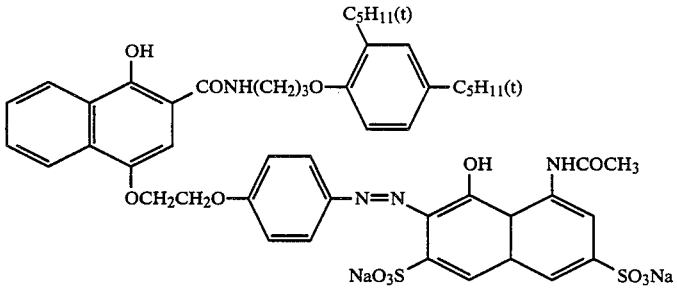
C-3
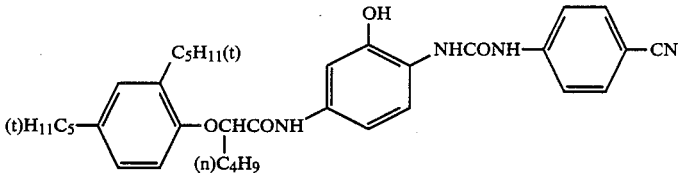
C-4
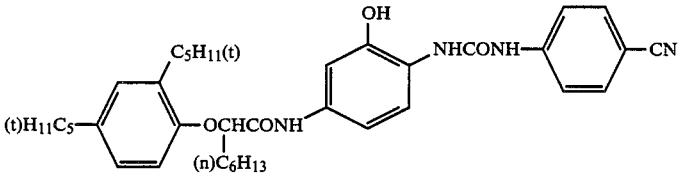
C-5
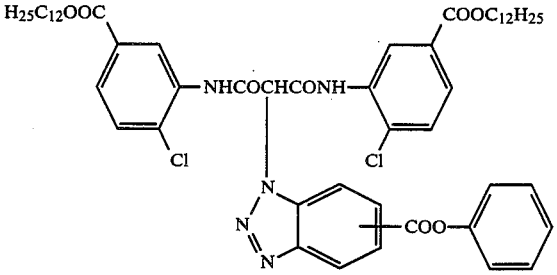

-continued
C-15
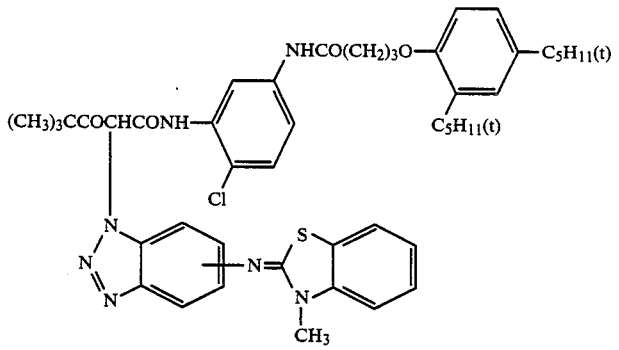
C-6
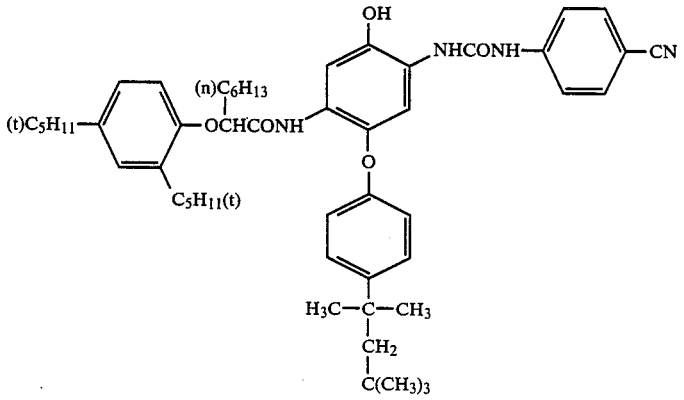
C-7
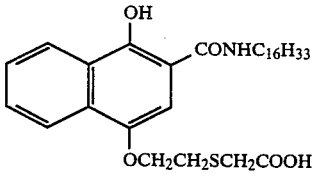
C-8
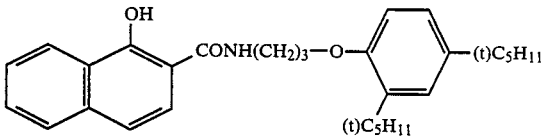
C-9
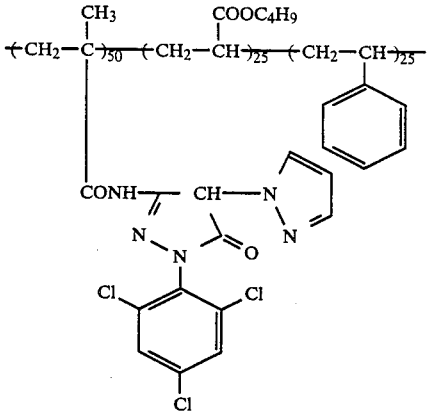
(molecular weight of about 20,000)
C-10
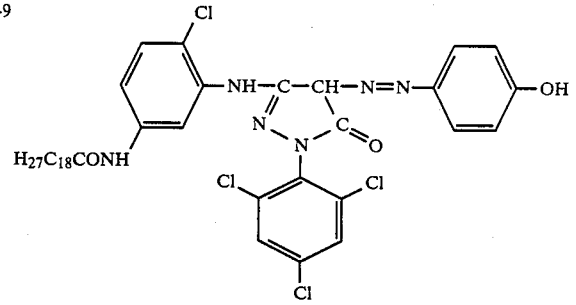
C-11
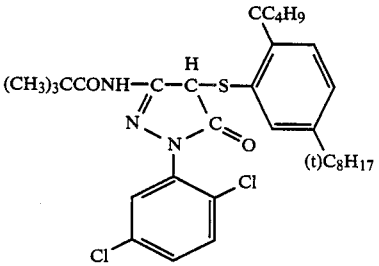

-continued
C-12
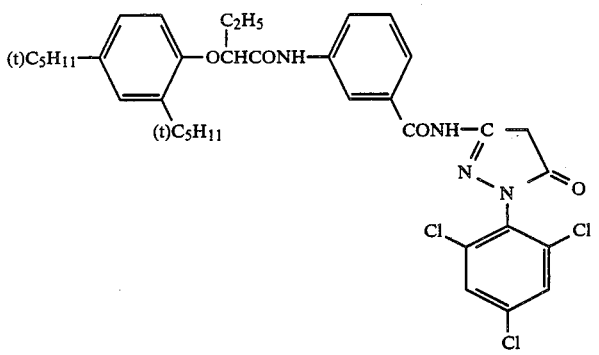
C-13
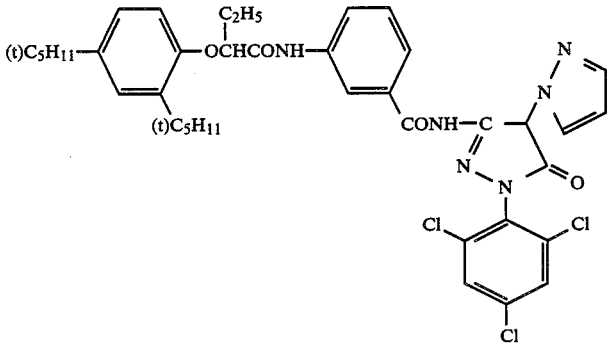
C-14
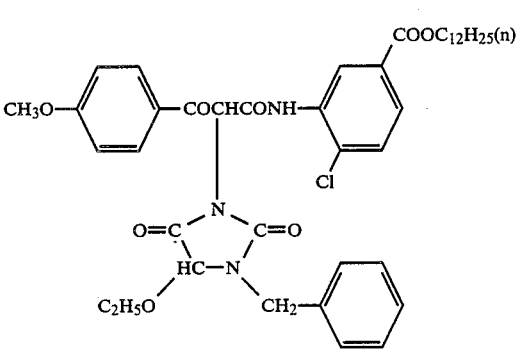
Cpd A
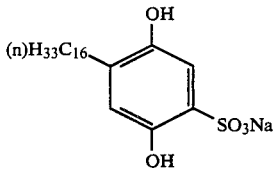
Cpd B
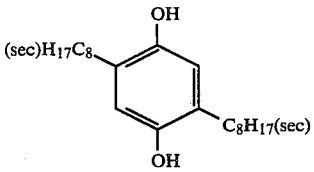
Sensitizing Dye I
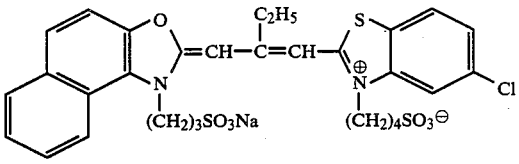
Sensitizing Dye II
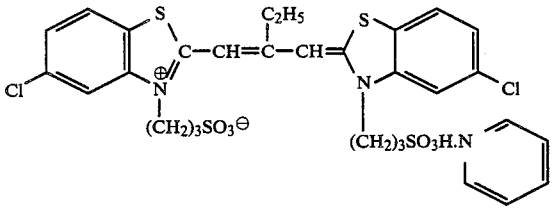
Sensitizing Dye III
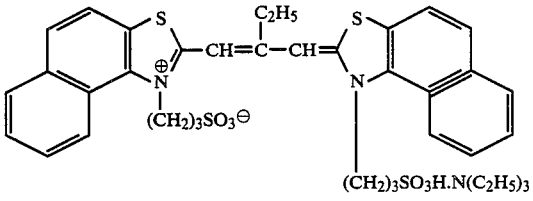
Sensitizing Dye IV
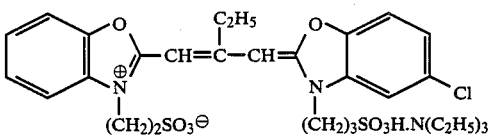

-continued

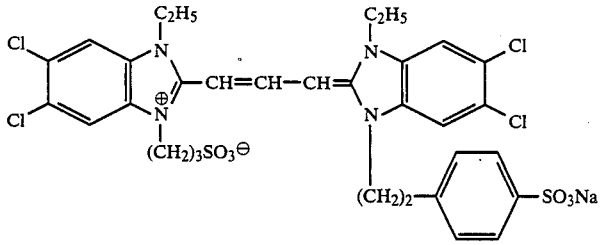

Sensitizing Dye V

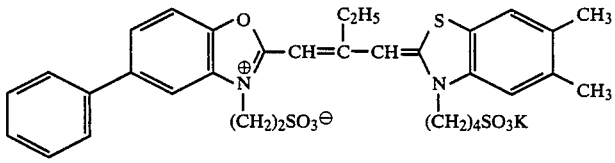

Sensitizing Dye VI

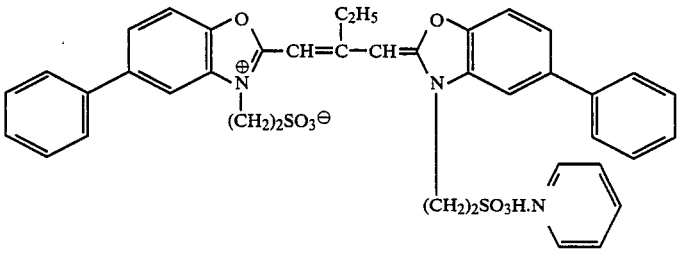

Sensitizing Dye VII

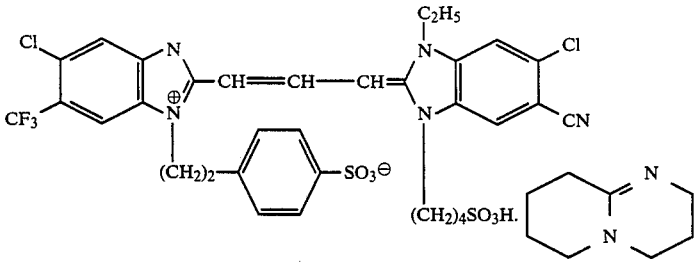

Sensitizing Dye VIII

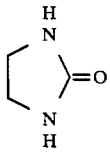

S-2

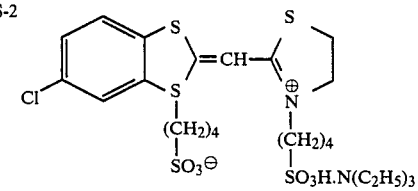

Sensitizing Dye IX $CH_2{=}CH{-}SO_2{-}CH_2{-}CONH{-}CH_2$
$CH_2{=}CH{-}SO_2{-}CH_2{-}CONH{-}CH_2$

H-1

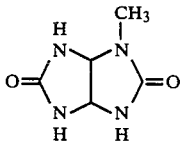

S-1

The multilayer color photographic negative film thus prepared was cut into a width of 35 mm and used in a camera for photographing a standard subject outdoors. The film was continuously processed by the following processing steps using an automatic processor until the replenisher for the color developer was supplied in an amount of 3 times the volume of the developer tank.

| Processing Step | | | | |
|---|---|---|---|---|
| Step | Time | Temp. | Tank | Replenisher* |
| Color Development | 3 min 15 sec | 38° C. | 8 liter | 38 ml |
| Bleach | 4 min 20 sec | 38° C. | 8 liter | 18 ml |
| Fix | 3 min 15 sec | 38° C. | 8 liter | 33 ml |
| Water Wash (1) | shown in | 35° C. | 4 liter | — |

-continued

| Step | Processing Step Time | Temp. | Tank | Replenisher* |
|---|---|---|---|---|
| Water Wash (2) | Table 2 shown in Table 2 | 35° C. | 4 liter | 1000 ml |
| Stabilization | Table 2 shown in Table 2 | 38° C. | 4 liter | 33 ml |

*Per 1 meter of the color film having a width of 35 mm.

In the above processing steps, water wash (1) and water wash (2) were performed in a countercurrent system from (2) to (1), and the amount of the processing solution carried from the fix step to the water wash step was about 70 ml/m$^2$.

The compositions of the processing solutions used in the steps were as follows.

| | For Tank | Replenisher |
|---|---|---|
| Color Developer | | |
| Diethylenetriaminepenta-acetic Acid | 1.0 g | 1.1 g |
| 1-Hydroxyethylidene-1,1-diphosphonic Acid | 2.0 g | 2.2 g |
| Benzyl Alcohol | Shown in Table 2 | |
| 1,2-Cyclohexanediamine-tetraacetic Acid | Shown in Table 2 | |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 ml | — |
| Hydroxylamine Sulfate | 2.4 g | 2.6 g |
| 4-(N—Ethyl-N—β-hydroxyethyl-amino)-2-methylaniline Sulfate | 4.5 g | 5.0 g |
| Water to make | 1 liter | 1 liter |
| pH | 10.00 | 10.00 |
| Bleach Solution | | |
| Ethylenediaminetetraacetic Acid Ferric Ammonium Salt | 100 g | 110 g |
| Ethylenediaminetetraacetic Acid Disodium Salt | 10 g | 11 g |
| Aqueous Ammonia | 7 ml | 5 ml |
| Ammonium Nitrate | 10.0 g | 12.0 g |
| Ammonium Bromide | 150 g | 170 g |
| Water to make | 1 liter | 1 liter |
| pH | 6.0 | 5.8 |
| Fix Solution | | |
| Ethylenediaminetetraacetic Acid Disodium Salt | 1.0 g | 1.2 g |
| Sodium Sulfite | 4.0 g | 5.0 g |
| Sodium Bisulfite | 4.6 g | 5.8 g |
| Ammonium Thiosulfate (70%) | 175 ml | 200 ml |
| Water to make | 1 liter | 1 liter |
| pH | 6.6 | 6.6 |

-continued

| | For Tank | Replenisher |
|---|---|---|
| Stabilizine Solution | | |
| Formalin (37% formaldehyde (w/v)) | 2.0 ml | 3.0 ml |
| Polyoxyethylene-p-monononyl phenyl Ether (mean polymerization degree 10) | 0.3 g | 0.45 g |
| Water to make | 1 liter | 1 liter |

In each continuous processing, the change of Dmin between the start and the running finish was measured and the results are shown in Table 2.

TABLE 2

| No. | Processing Times for Water Wash and Stabilization: Water Wash (1) | Water Wash (2) | Stabilization | Total | Benzyl Alcohol (ml/liter) | 1,2-Cyclohexanediaminetetraacetic Acid (g/liter) | ΔDmin BL | GL | RL |
|---|---|---|---|---|---|---|---|---|---|
| 19 | 1'30" | 1'30" | 1'00" | 4'00" | — | — | +0.02 | +0.02 | 0 |
| 20 | 1'00" | 1'00" | 1'00" | 3'00" | — | — | +0.02 | +0.01 | 0 |
| 21 | 45" | 45" | 30" | 2'00" | — | — | +0.03 | +0.06 | +0.01 |
| 22 | 30" | 30" | 30" | 1'30" | — | — | +0.04 | +0.10 | +0.02 |
| 23 | 45" | 45" | 30" | 2'00" | 5 | — | +0.04 | +0.09 | +0.03 |
| 24 | 45" | 45" | 30" | 2'00" | 5 | 1.0 | +0.03 | +0.05 | +0.01 |
| 25 | 45" | 45" | 30" | 2'00" | — | 1.0 | +0.01 | 0 | 0 |
| 26 | 30" | 30" | 30" | 1'30" | — | 1.0 | +0.01 | +0.01 | 0 |
| 27 | 30" | 30" | 30" | 1'30" | 5 | 1.0 | +0.04 | +0.08 | +0.01 |
| 28 | 1'00" | 1'00" | 1'00" | 3'00" | 5 | — | +0.03 | +0.02 | +0.01 |

Nos. 19–24, 27, and 28: comparison examples
Nos. 25 and 26: examples of this invention As is clear from the results of Table 2 above, when the time for the sum of the water wash steps and the stabilization step is not more than 2 minutes, the formation of stain is greatly increased and almost no effect for preventing the formation of stains is obtained by adding the chelating agent in this invention in the existence of benzyl alcohol. However, the formation of stains is greatly reduced by the chelating agent in this invention in the absence of benzyl alcohol.

EXAMPLE 3

The samples obtained by the running test No. 19 to No. 28 in Example 2 described above was allowed to stand for 10 days at 40° C. and 70% RH and the density change of stains with the passage of time was measured. The results obtained are shown in Table 3 below.

TABLE 3

| No. | ΔDmin BL | GL | RL |
|---|---|---|---|
| 19 | +0.05 | +0.06 | 0 |
| 20 | +0.07 | +0.09 | +0.01 |
| 21 | +0.10 | +0.12 | +0.02 |
| 22 | +0.15 | +0.16 | +0.04 |
| 23 | +0.11 | +0.11 | +0.03 |
| 24 | +0.09 | +0.10 | +0.02 |
| 25 | +0.05 | +0.05 | 0 |
| 26 | +0.06 | +0.06 | 0 |
| 27 | +0.13 | +0.15 | +0.02 |
| 28 | +0.08 | +0.10 | +0.01 |

Nos. 19–24, 27, 28: comparison examples
Nos. 25 and 26: examples of this invention As shown in Table 3 above, according to this invention, the increase of stains after processing is low even when the washing time is short.

EXAMPLE 4

A multilayer color photographic paper having Layer 1 to Layer 11 shown below on a paper support both surfaces of which were coated with polyethylene was prepared. The polyethylene coating at the emulsion side on the paper support contained titanium white as a white pigment and a small amount of Ultramarine blue as a bluish dye.

Layer 1: Antihalation Layer

Black Colloid Silver: 0.10 g/m$^2$ as silver
Gelatin: 2.0 g/m$^2$

Layer 2: Low-Speed Red-Sensitive Emulsion Layer

Silver Iodobromide Emulsion (silver iodide 3.5 mol%, mean grain size 0.7 μm) spectrally sensitized by red-sensitizing dyes (*5 and *6): 0.15 g/m$^2$ as silver
Gelatin: 1.0 g/m$^2$
Cyan Coupler (*3-1): 0.20 g/m$^2$
Cyan Coupler (*3-2): 0.11 g/m$^2$
Fading Preventing Agent (*2): 0.15 g/m$^2$
Coupler Solvents (*18 and *1): 0.06 g/m$^2$ Layer 3: High-Speed Red-Sensitive Emulsion Layer Silver Iodobromide Emulsion (silver iodide 8.0 mol%, mean grain size 0.7 μm) spectrally sensitized by red-sensitizing dyes (*5 and *4): 0.10 g/m$^2$ as silver
Gelatin: 0.50 g/m$^2$
Cyan Coupler (*3-1): 0.07 g/m$^2$
Cyan Coupler (*3-2): 0.04 g/m$^2$
Fading Preventing Agent (*2): 0.05 g/m$^2$
Coupler Solvents (*18 and *1): 0.02 g/m$^2$ Layer 4: Interlayer Yellow Colloid Silver: 0.02 g/m$^2$ as silver
Gelatin: 1.00 g/m$^2$
Color Mixing Preventing Agent (*14): 0.08 g/m$^2$
Color Mixing Preventing Agent Solvent (*13): 0.16 g/m$^2$
Polymer Latex (*6): 0.10 g/m$^2$ Layer 5: Low-Speed Green-Sensitive Emulsion Layer Silver Iodobromide Emulsion (silver iodide 2.5 mol%, mean grain size 0.4 μm) spectrally sensitized by green-sensitizing dyes (*12): 0.20 g/m$^2$ as silver
Gelatin: 0.70 g/m$^2$
Magenta Coupler (*11): 0.40 g/m$^2$
Fading Preventing Agent A (*10): 0.05 g/m$^2$
Fading Preventing Agent B (*9): 0.05 g/m$^2$
Fading Preventing Agent C (*8): 0.02 g/m$^2$
Coupler Solvents (*7): 0.15 g/m$^2$ Layer 6: High-Speed Green-Sensitive Emulsion Layer Silver Iodobromide Emulsion (silver iodide 3.5 mol%, mean grain size 0.9 μm) spectrally sensitized by green-sensitizing dyes (*12): 0.20 g/m$^2$ as silver
Gelatin: 0.70 g/m$^2$
Magenta Coupler (*11): 0.40 g/m$^2$
Fading Preventing Agent A (*10): 0.05 g/m$^2$
Fading Preventing Agent B (*9): 0.05 g/m$^2$
Fading Preventing Agent C (*8): 0.02 g/m$^2$
Coupler Solvents (*7): 0.15 g/m$^2$ Layer 7: Yellow Filter Layer Yellow Colloid Silver: 0.20 g/m$^2$ as silver
Gelatin: 1.00 g/m$^2$
Color Mixing Preventing Agent (*14): 0.06 g/m$^2$
Color Mixing Preventing Agent Solvent (*13): 0.24 g/m$^2$
Irradiation Preventing Dyes (*21 and *22): 0.24 g/m$^2$ Layer 8: Low-Speed Blue-Sensitive Emulsion Layer Silver Iodobromide Emulsion (silver iodide 2.5 mol%, mean grain size 0.5 μm) spectrally sensitized by blue-sensitizing dyes (*16): 0.15 g/m$^2$ as silver
Gelatin: 0.50 g/m$^2$
Yellow Coupler (*15): 0.20 g/m$^2$
Coupler Solvents (*18): 0.05 g/m$^2$ Layer 9: High-Speed Blue-Sensitive Emulsion Layer Silver Iodobromide Emulsion (silver iodide 2.5 mol%, mean grain size 1.4 μm) spectrally sensitized by blue-sensitizing dyes (*16): 0.20 g/m$^2$ as silver
Gelatin: 0.50 g/m$^2$
Yellow Coupler (*15): 0.20 g/m$^2$
Coupler Solvents (*18): 0.05 g/m$^2$ Layer 10: Ultraviolet Absorbing Layer Gelatin: 1.50 g/m$^2$
Ultraviolet Absorbent (*19): 1.0 g/m$^2$
Ultraviolet Absorbent Solvent (*18): 0.30 g/m$^2$
Color Mixing Preventing Agent (*17): 0.08 g/m$^2$ Layer 11: Protective Layer Fine Grain Silver Chlorobromide (silver chloride 77 mol%, mean grain size 0.2 μm): 0.07 g/m$^2$ as silver
Gelatin: 1.0 g/m$^2$
Hardening Agent (*20): 0.17 g/m$^2$ The compounds used above were as follows.

*1: Dioctyl Phthalate
*2: 2-(2-Hydroxy-3-sec-butyl-5-t-butylphenyl)benzotriazole
*3-1: 2-[α-(2,4-Di-t-amylphenoxy)butaneamido-4,6-dichloro-5-ethylphenol
*3-2: 4-Chloro-2-(2-chlorobenzamido)-5-[α-(4-t-amyl-2-chlorophenoxy)octaneamido]phenol
*4: 5,5'-Dichloro-3,3'-di(3-sulfobutyl)-9-ethylthiacarbonylcyan Sodium Salt
*5: Triethylammonium-3-[2-{2-[3-(3-sulfopropyl)naphtho(1,2-d)thiazoline-2-indenemethyl]-1-butenyl}-3-naphtho(1,2-d)thiazolino]propane Sulfonate
*6: Polyethyl Acrylate
*7: Phosphoric ACid Trioctyl Ester
*8: 2,4-Di-t-hexylhydroquinone
*9: Di-(2-hydroxy-3-t-butyl-5-methylphenyl)methane
*10: 3,3,3',3'-Tetramethyl-5,6,5',6'-tetrapropoxy-1,1'-bisspiroindane
*11:

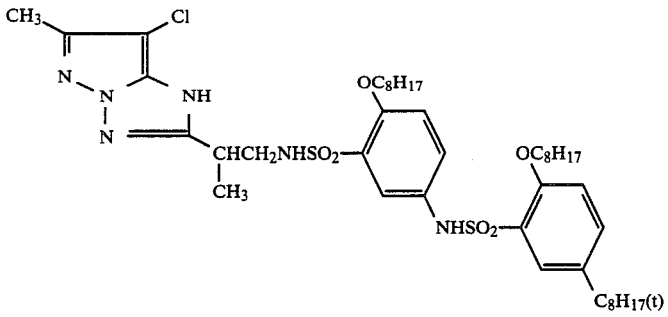

*12: 5,5'-Diphenyl-9-ethyl-3,3'-disulfopropyloxacarbocyanine Sodium Salt
*13: Phosphoric Acid o-Cresyl Ester
*14: 2,4-Di-t-octylhydroquinone
*15: α-Pivaloyl-α-[(2,4-dioxo-1-benzyl-5-ethoxyhydatoin-3-yl)-2-chloro-5-(α-2,4-dioxo-5-amylphenoxy)butane-amino]acetoanilide
*16: Triethylammonium 3-[2-(3-benzylrhodanin-5-iridine)-3-benzoxazolynyl]propane Sulfonate
*17: 2,4-Di-sec-octylhydroquinone
*18: Phosphoric Acid Trinonyl Ester
*19: 5-Chloro-2-(2-hydroxy-3-t-butyl-5-t-octyl)phenylbenztriazole
*20: 1,4-Bis(vinylsulfonylacetamido)ethane
*21:

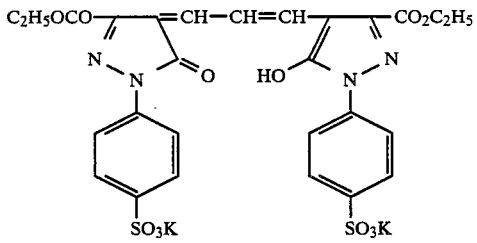

*22:

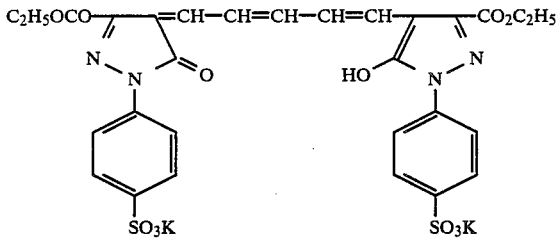

The color reversal photographic material thus prepared was cut in a width of 8.25 cm, imagewise exposed, and continuously processed by the following processing steps using a roll-transporting type automatic processor such that the replenisher for the color developer was supplied in an amount of 3 times the volume of the developer tank.

The processing steps were as follows.

| Processing Step | Time | Temperature | Replenisher (ml/m²) |
|---|---|---|---|
| Black-and-White | 1 min 15 sec | 38° C. | 330 |

-continued

| Processing Step | Time | Temperature | Replenisher (ml/m²) |
|---|---|---|---|
| Development | | | |
| 1st Water Wash | 1 min 30 sec | 33° C. | 1000 |
| Color Development | 2 min 15 sec | 38° C. | 330 |
| 2nd Water Wash | 45 sec | 33° C. | 1000 |
| Blix | 1 min | 38° C. | 220 |
| Stabilization (1) | | | |
| Stabilization (2) | shown in Table 4 | 33° C. | 200 |
| Stabilization (3) | | | |

The stabilization solution was used in the countercurrent system of 3 tanks as (3)→(2)→(1). Also, during the movement of the color photographic material from the 1st water wash bath to the color development bath, a reversal exposure was applied thereto. The amount of the processing solution carried from the blix step to the stabilization step was about 30 ml/m².

The compositions of the processing solutions were as follows.

| | For Tank | Replenisher |
|---|---|---|
| Black-and-White Developer | | |
| Nitrilo-N,N,N—trimethylenephosphonic Acid.Pentasodium Salt | 0.6 g | 0.6 g |
| Diethylenetriaminepentaacetic Acid.Pentasodium Salt | 4.0 g | 4.0 g |
| Potassium Sulfite | 30.0 g | 30.0 g |
| Potassium Thiocyanate | 1.2 g | 1.2 g |
| Potassium Carbonate | 35.0 g | 35.0 g |
| Hydroquinone Monosulfonate. Potassium Salt | 25.0 g | 25.0 g |
| Diethylene Glycol | 15.0 ml | 15.0 ml |
| 1-Phenyl-4-hydroxymethyl-4-methyl-3-pyrazolidone | 2.0 g | 2.0 g |
| Potassium Bromide | 0.5 g | — |
| Potassium Iodide | 5.0 ml | — |
| Water to make | 1 liter | 1 liter |
| pH | 9.70 | 9.70 |
| Color Developer | | |
| Benzyl Alcohol | Shown in Table 4 | |
| Diethylene Glycol | Shown in Table 4 | |
| 1,2-Cyclohexanediaminetetraacetic Acid | Shown in Table 4 | |
| 3,6-Dithia-1,8-octanediol | 0.2 g | 0.25 g |
| Nitrilo-N,N,N—trimethylenephosphonic Acid.Pentasodium Salt | 0.5 g | 0.63 g |
| Diethylenetriaminepentaacetic Acid.Pentasodium Salt | 2.0 g | 2.5 g |
| Sodium Sulfite | 2.0 g | 2.5 g |
| Potassium Carbonate | 25.0 g | 31.3 g |
| Hydroxylamine Sulfate | 3.0 g | 3.8 g |
| N—Ethyl-N—(β-methanesulfonamidoethyl)-3-methyl-4-aminoaniline | 5.0 g | 6.3 g |

-continued

| | For Tank | Replenisher |
|---|---|---|
| Sulfate | | |
| Potassium Bromide | 0.5 g | — |
| Potassium Iodide | 1.0 ml | — |
| Water to make | 1 liter | 1 liter |
| pH | 10.25 | 10.40 |

Blix Solution (Tank solution and replenisher were common)

2-Mercapto-1,3,4-triazole: 1.0 g
Ethylenediaminetetraacetic Acid. Disodium Dihydrate: 5.0 g
Ethylenediaminetetraacetic Acid Fe(III).Ammonium Monohydrate: 80.0 g
Sodium Sulfite: 15.0 g
Sodium Thiosulfate (700 g/liter): 160.0 ml
Glacial Acetic Acid: 5.0 ml
Water to make: 1 liter
pH: 6.50

Stabilizing Solution (Tank solution and replenisher were same composition)

1-Hydroxyethylidene-1,1-diphosphonic Acid (60%): 1.5 ml
Nitrilotriacetic Acid: 1.0 g
Ethylenediaminetetraacetic Acid: 0.5 g
N,N,N',N'-Tetramethylenephosphonic Acid: 1.0 g
$BiCl_3$ (40% aq. soln.): 0.50 g
$MgSO_4.7H_2O$: 0.20 g
$ZnSO_4$:0.3 g
Ammonium Alum: 0.5 g
5-Chloro-2-methyl-4-isothiazoline-3-one: 30 mg
2-Methyl-4-isothiazolin-3-one: 10 mg
2-Octyl-4-isothiazolin-3-one: 10 mg
Ethylene Glycol: 1.5 g
Sulfanylamide: 0.1 g
1,2,3-Benzotriazole: 1.0 g
Ammonium Sulfite (40% aq. soln.): 1.0 g
Aqueous Ammonia (26%): 2.6 ml
Polyvinylpyrrolidone: 1.0 g
Optical Whitening Agent (4,4'-diaminostilbene series): 1.0 g
Water to make: 1 liter
pH with KOH: 7.0

Then, the change of staining between the start of the running and the finish of the running was measured, and the results obtained are shown in Table 4 below.

TABLE 4

| No. | Total Processing time for Stabilization | Color Developer Additives: Benzyl alcohol (ml) | Diethylene glycol (ml) | 1,2-Cyclohexane-diaminetetra-acetic acid (g) | ΔDmin BL | GL | RL |
|---|---|---|---|---|---|---|---|
| 29 | 3'00" | 10 | 10 | — | +0.01 | 0 | 0 |
| 30 | 2'30" | 10 | 10 | — | +0.02 | +0.01 | 0 |
| 31 | 2'00" | 10 | 10 | — | +0.06 | +0.03 | +0.01 |
| 32 | 1'30" | 10 | 10 | — | +0.11 | +0.05 | +0.02 |
| 33 | 2'00" | 10 | 10 | 0.2 | +0.05 | +0.03 | +0.01 |
| 34 | 2'00" | — | — | — | +0.05 | +0.03 | +0.01 |
| 35 | 2'00" | — | — | 0.2 | +0.01 | 0 | 0 |
| 36 | 1'30" | — | — | 0.2 | +0.02 | 0 | 0 |

Nos. 29–34: comparison examples
Nos. 35 and 36: examples of this invention

As shown in the above table, according to this invention, the formation of stains was not increased and good photographic properties were obtained in the stabilization processing of a short period of time.

EXAMPLE 5

The color papers Nos. 29 to 36 processed by the running processing in Example 4 were allowed to stand for one month at 80° C., and the change of stain was measured. The results are shown in Table 5 below.

TABLE 5

| No. | ΔDmin BL | GL | RL |
|---|---|---|---|
| 29 | +0.13 | +0.07 | +0.02 |
| 30 | +0.17 | +0.10 | +0.04 |
| 31 | +0.21 | +0.12 | +0.06 |
| 32 | +0.24 | +0.13 | +0.07 |
| 33 | +0.17 | +0.09 | +0.04 |
| 34 | +0.18 | +0.10 | +0.05 |
| 35 | +0.10 | +0.05 | +0.01 |
| 36 | +0.11 | +0.05 | +0.01 |

Nos. 29–34: comparison examples
Nos. 35 and 36: examples of this invention

As shown in the above table, according to this invention, the increase of stain after processing is less in spite of the shortened time for the stabilization processing.

EXAMPLE 6

By following the same procedure as Example 1 except that the spectral sensitizers for the blue-sensitive emulsion layer and the green-sensitive emulsion layer and also the irradiation preventing dye for the green-sensitive emulsion layer were changed as follows, a multilayer color photographic paper was prepared.

Spectral Sensitizers

For Blue-Sensitive Emulsion Layer:

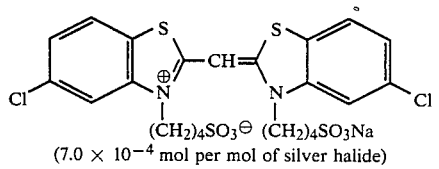

($7.0 \times 10^{-4}$ mol per mol of silver halide)

For Green-Sensitive Emulsion Layer:

-continued

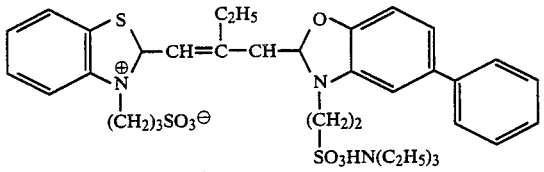

(4.0 × $10^{-4}$ mol per mol of silver halide)

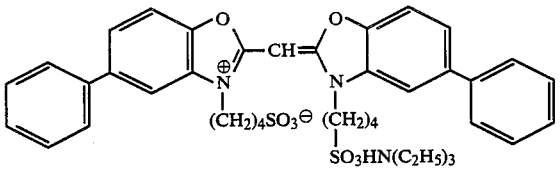

(7.0 × $10^{-5}$ mol per mol of silver halide)

Irradiation Preventing Dye:
For Green-Sensitive Emulsion Layer:

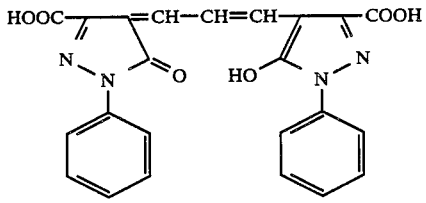

The multilayer color photographic paper thus obtained was imagewise exposed and continuously processed by the following processing steps using an automatic processor until the replenisher for the color developer was supplied in an amount of 3 times the volume of the developer tank.

| Processing Step | Temp. | Time | Tank Volume |
|---|---|---|---|
| Color Development | 35° C. | 2 min | 16 liters |
| Blix | 33° C. | 1 min 30 sec | 10 liters |
| Stabilization (1) | 30° C. | 1 min | 3.5 liters |
| Stabilization (2) | 30° C. | 1 min | 3.5 liters |
| Stabilization (3) | 30° C. | 1 min | 3.5 liters |
| Drying | 80° C. | 50 sec | |

The stabilization processing was performed by a 3-stage countercurrent system of from stabilization (3) to stabilization (1). Also, the amount of transfer from each pre-bath to each of the blix step, the stabilization (1), stabilization (2), and stabilization (3) was 60 ml/$m^2$.

Also, the amounts of the replenishers for the color developer and the blix solution were 160 ml and 60 ml, respectively, per square meter of the color photographic paper.

The amount of the replenisher for the stabilization step was as follows.

A: Five liters per square meter of the color paper of the stabilizing solution was supplied.

B: Two liters per square meter of the color paper of the stabilizing solution was supplied.

C: Five hundreds ml per square meter of the color paper of the stabilizing solution was supplied.

D: Twenty five ml per square meter of the color paper of the stabilizing solution was supplied.

Also, the compositions of the processing solutions were as follows.

| | For Tank | Replenisher |
|---|---|---|
| Color Developer | | |
| Water | 800 ml | 800 ml |
| 1,2-Cyclohexanediamine-N,N,N',N'—tetraacetic Acid Sodium Salt | Shown in Table 6 | |
| Benzyl Alcohol | Shown in Table 6 | |
| Diethylene Glycol | Shown in Table 6 | |
| Sodium Sulfite | 2.0 g | 2.3 g |
| Potassium Bromide | 0.1 g | — |
| Potassium Carbonate | 30.0 g | 25.0 g |
| N—Ethyl-N—(β-methanesulfonamidoethyl)-3-methyl-4-aminoaniline Sulfate | 5.5 g | 7.5 g |
| Hydroxylamine Sulfate | 1.0 g | 1.5 g |
| Optical Whitening Agent (stilbene series) | 1.0 g | 1.5 g |
| Water to make | 1 liter | 1 liter |
| pH adjusted by KOH | 10.20 | 10.60 |
| Blix Solution | | |
| Water | 400 ml | 400 ml |
| Ammonium Thiosulfate (70%) | 150 ml | 300 ml |
| Sodium Sulfite | 18 g | 36 g |
| Ethylenediaminetetraacetic Acid Iron(III) Ammonium | 55 g | 110 g |
| Ethylenediaminetetraacetic Acid | 5 g | 10 g |
| Water to make | 1 liter | 1 liter |
| pH | 5.75 | 5.30 |
| Solubilizing Solution | | |
| 1-Hydroxyethylidene-1,1-diphosphonic Acid (60%) | 1.8 ml | 1.8 ml |
| Aqueous Ammonia (28%) | 1.8 ml | 1.8 ml |
| Water to make | 1 liter | 1 liter |
| pH adjusted by KOH | 7.0 | 7.0 |

At the end of the continuous processing, the unexposed color photographic paper was processed in the same manner as above except supplying no replenisher for each processing step, and after drying, yellow staining was measured. Furthermore, the color paper thus processed was allowed to stand for 30 days under the conditions of 60° C. and 70% RH, and thereafter, yellow stains were further measured. The results obtained are shown in Table 6 below.

TABLE 6

| No. | Benzyl Alcohol*1 (ml/liter)/ Diethylene glycol (ml/liter) | Compound*2 of Invention (g/liter) | Replenisher Amount (ml/$m^2$) | Replenisher (ml/$m^2$)/ Solution from Prebath (ml/$m^2$) | Yellow Stain | Yellow Stain after 30 days (60° C. 70% RH) |
|---|---|---|---|---|---|---|
| 37 | 10/15 | 0 | 5,000 | 83/1 | 0.12 | 0.21 |
| 38 | 0 | 0 | 5,000 | 83/1 | 0.11 | 0.20 |
| 39 | 10/15 | 0.2 | 5,000 | 83/1 | 0.11 | 0.20 |
| 40 | 0 | 0.2 | 5,000 | 83/1 | 0.09 | 0.18 |
| 41 | 10/15 | 0 | 2,000 | 33/1 | 0.18 | 0.30 |
| 42 | 0 | 0 | 2,000 | 33/1 | 0.13 | 0.26 |
| 43 | 10/15 | 0.2 | 2,000 | 33/1 | 0.14 | 0.25 |
| 44 | 0 | 0.2 | 2,000 | 33/1 | 0.10 | 0.19 |

TABLE 6-continued

| No. | Benzyl Alcohol*1 (ml/liter)/ Diethylene glycol (ml/liter) | Compound*2 of Invention (g/liter) | Replenisher Amount (ml/m²) | Replenisher (ml/m²)/ Solution from Prebath (ml/m²) | Yellow Stain | Yellow Stain after 30 days (60° C. 70% RH) |
|---|---|---|---|---|---|---|
| 45 | 10/15 | 0 | 500 | 8.3/1 | 0.22 | 0.38 |
| 46 | 0 | 0 | 500 | 8.3/1 | 0.18 | 0.35 |
| 47 | 10/15 | 0.2 | 500 | 8.3/1 | 0.20 | 0.34 |
| 48 | 0 | 0.2 | 500 | 8.3/1 | 0.11 | 0.20 |
| 49 | 10/15 | 0 | 25 | 0.41/1 | 0.30 | 0.50 |
| 50 | 0 | 0 | 25 | 0.41/1 | 0.29 | 0.50 |
| 51 | 10/15 | 0.5*3 | 25 | 0.41/1 | 0.20 | 0.51 |
| 52 | 0 | 0.5*3 | 25 | 0.41/1 | 0.13 | 0.22 |

*1Concentration in the tank solution. In the replenisher concentration, benzyl alcohol/diethylene glycol is 19 ml/10 ml.
*2Sodium 1,2-cyclohexanediaminetetraacetate. Numerical value is tank concentration. The replenisher concentration is 0.23 g/liter.
*3The replenisher concentration is 0.53 g/liter.
Nos. 37–39, 41–43, 45–47, and 49–51: comparison examples
Nos. 40, 44, 48, and 52: examples of this invention As is clear from the results of Table 6, when the amount of the replenisher for the stabilizing solution is 5,000 ml/m², the formation of yellow stains is almost the same regardless of the presence or absence of benzyl alcohol and the chelating compound in this invention, but when the amount of the replenisher is reduced to 2,000 ml/m², the formation of yellow stains is reduced to some extent for the comparison sample (No. 42) containing no benzyl alcohol and the comparison sample (No. 43) containing the compound in this invention (0.2 g/liter) as compared to the comparison sample (No. 41), although the effect is insufficient. On the other hand, the formation of stain can be sufficiently prevented by adding the compound in this invention and omitting benzyl alcohol an seen in the case of the sample of this invention (No. 44), and the effect is more remarkable when the amount of the replenisher is reduced to 500 ml/m². However, when the amount of the replenisher is reduced to 25 ml/m², the formation of stain cannot be prevented to a practical level, although the effect of preventing the formation of stain is obtained to some extent.

EXAMPLE 7

A multilayer color photographic film obtained by following the same procedure as Example 2 was cut into a width of 35 mm and used for photographing standard subject outdoors. The color film was continuously processed by the following steps using an automatic processor.

| Processing Step | Time | Temp. | Tank | Replenisher* |
|---|---|---|---|---|
| Color Development | 3 min 20 sec | 38° C. | 8 liter | 38 ml |
| Bleach | 4 min 20 sec | 38° C. | 8 liter | 18 ml |
| Fix | 3 min 15 sec | 38° C. | 8 liter | 33 ml |
| Water Wash (1) | 1 min 30 sec | 35° C. | 4 liter | — |

-continued

| Processing Step | Time | Temp. | Tank | Replenisher* |
|---|---|---|---|---|
| Water Wash (2) | 1 min 30 sec | 35° C. | 4 liter | shown in Table 7 |
| Stabilization | 1 min 5 sec | 38° C. | 4 liter | 33 ml |

*The amount per square meter of a color film having a width of 35 mm.

In the aforesaid processing steps, water washes (1) and (2) were performed by a countercurrent system of from (2) to (1). Then, the compositions of the processing solutions were shown below. In addition, the compositions of the bleach solution, the fix solution, and the stabilizing solution were same as those in Example 2.

| Color Developer | For Tank | Replenisher |
|---|---|---|
| Diethylenetriaminepentaacetic Acid | 1.0 g | 1.1 g |
| 1-Hydroxyethylidene-1,1-diphosphonic Acid | 2.0 g | 2.2 g |
| Benzyl Alcohol | Shown in Table 8 | |
| Diethylene Glycol | Shown in Table 8 | |
| 1,2-Cyclohexanediaminetetra-acetic Acid Sodium | Shown in Table 8 | |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 g | 2.6 g |
| N—Ethyl-N—(β-hydroxyethylamino-2-methylaniline Sulfate | 4.5 | 5.0 |
| Water to make | 1 liter | 1 liter |
| pH | 10.00 | 10.05 |

Wash Water and replenisher thereof were shown in Table 7.

The contents of the processing steps and the contents were as shown in Table 7 below.

TABLE 7

| Continuous Processing | Amount of Solution from Pre-bath (A)*1 | Replenisher Amount (B)*2 | Replenisher/ Solution from Pre-bath (B/A) | Quality of Wash Water and Replenisher | Processing Amount |
|---|---|---|---|---|---|
| E | 2 ml | 1,000 ml*3 | 500/1 | tap water*4 | 50 m/day × 20 days |
| F | 2 ml | 30 ml | 15/1 | tap water*4 | 50 m/day × 20 days |

In Table 7 above:

*1: One meter of the color film was sampled directly before entering the water wash bath, immediately immersed in 1 liter of distilled water, and stirred for 10 minutes at 30° C. by a magnetic stirrer. Then, the solution was sampled, the concentration of thiosulfate ion $C_1$ (g/liter) in the solution was determined, at the same time, the concentration $C_2$ (g/liter) of thiosulfate ion in the fixed solution on the pre-bath was determined, and the carrying out amount A (ml) was calculated by the following equation:

$$C_1 \times \frac{(1000 + A)}{A} = C_2$$

The determination of the thiosulfate ion was performed by an acid iodine titration method after masking sulfite ions by the addition of formamide.

*2: The amount of replenishing water per meter of sample.

*3: Similar to the standard wash water amount in the case of saving wash water.

*4: Tap water of the following quality was used.
pH: 6.8
Calcium: 25 mg/liter
Magnesium: 8 mg/liter After continuously performing the aforesaid processing under the above-described conditions for 20 days, the processing system was further used for the following processing. The color photographic negative film as described above was cut into a width of 35 mm, wedge exposed at 250 CMS using a tungsten light the color temperature of which was adjusted to 4,800K using a filter, and then continuously processed by the same processing solutions using the automatic processor. Then, the minimum density of yellow was measured. The results obtained are shown in Table 8.

TABLE 8

| No. | Benzyl Alcohol*1 (g/liter)/ Diethylene Glycol (g/liter) | (D)*2 (g/liter) | (E)*3 | (F)*4 |
|---|---|---|---|---|
| 53 | 10/15 | 0 | E | 0.69 |
| 54 | 0 | 0 | E | 0.68 |
| 55 | 10/15 | 2.0 | E | 0.67 |
| 56 | 0 | 2.0 | E | 0.60 |
| 57 | 10/15 | 0 | F | 0.77 |
| 58 | 0 | 0 | F | 0.75 |
| 59 | 10/15 | 2.0 | F | 0.73 |
| 60 | 0 | 2.0 | F | 0.60 |

*1Benzyl alcohol/diethylene glycol same as that in Table 6 of Example 6.
*2(D) Compound in this invention, i.e., 1,2-cyclohexanediaminetetraacetic acid sodium. The numeral is the concentration in the tank solution. The concentration in the replenisher is 2.1 g/liter.
*3(E) Water wash condition defined in Table 7
*4(F) Yellow stain.
In addition, Nos. 53 to 55 and 57 to 59 are comparison examples and Nos. 56 and 60 are the samples of this invention.

As is clear from the results shown in Table 8, when the amount of replenisher for wash water is reduced, the formation of yellow stain is greatly increased in the case of absence of the chelating compound of this invention, but the formation of yellow stain is sufficiently inhibited in the case of adding the chelating compound of this invention and omitting benzyl alcohol.

EXAMPLE 8

The silver halide color reversal photographic material prepared as in Example 4 was cut into a width of 8.25 cm, imagewise exposed, and continuously processed for 30 days per 50 meters a day by the following processing steps using a roll transportation type automatic processor. The continuous processing steps and the compositions of the processing solutions were as follows. In addition, the volume of each processing tank in the automatic processor was 15 liters and the transfer amount of the processing solution by the photographic material from the pre-bath was 30 ml per square meter of the color photographic material.

| Processing Step | Time | Temperature | Replenisher |
|---|---|---|---|
| Black-and-White Development | 1 min 15 sec | 38° C. | 330 ml |
| 1st Water Wash | 1 min 30 sec | 33° C. | 1000 ml |
| Color Development | 2 min 15 sec | 38° C. | 330 ml |
| 2nd Water Wash | 45 sec | 33° C. | 1000 ml |
| Blix | 1 min | 38° C. | 220 ml |
| Stabilization (1) | 30 sec | 33° C. | — |
| Stabilization (2) | 30 sec | 33° C. | — |
| Stabilization (3) | 30 sec | 33° C. | Shown in Table 9 |

The amount of the replenisher in the above steps is the amount per square meter of the color photographic film. Also, the replenishing system for the stabilization step was performed by a so-called countercurrent system in which the replenisher was supplied to tank (3), the overflowed solution from tank (3) was introduced into tank (2), and the overflowed solution from the tank (2) was introduced into tank (1). The reversal exposure was applied to the color photographic film while transferring the film from the 1st water wash tank to the color development tank.

The compostions for the processing solutions are shown below. In addition, the compositions of the black-and-white developer and the blix were same as those in Example 4.

| Color Developer | For Tank | Replenisher |
|---|---|---|
| Benzyl Alcohol | Shown in Table 9 | |
| Diethylene Glycol | Shown in Table 9 | |
| 1,2-Cyclohexanediaminetetraacetic Acid Sodium Salt | Shown in Table 9 | |
| 3,6-Dithia-1,8-octanediol | 0.2 g | 0.25 g |
| Nitrilo-N,N,N—trimethylenephosphonic Acid Pentasodium Salt | 0.5 g | 0.63 g |
| Diethylenetriaminetetraacetic Acid Pentasodium Salt | 2.0 g | 2.5 g |
| Sodium Sulfite | 2.0 g | 2.5 g |
| Potassium Carbonate | 25.0 g | 31.3 g |
| Hydroxylamine Sulfate | 3.0 g | 3.8 g |
| N—Ethyl-N—(β-methanesulfonamidoethyl)-3-methyl-4-aminoaniline Sulfate | 5.0 g | 6.3 g |
| Potassium Bromide | 0.5 g | — |
| Potassium Iodide | 1.0 mg | — |
| Water to make | 1 liter | 1 liter |
| pH | 10.25 | 10.40 |

Stabilizing Solution (Tank solution and replenisher have the same composition)

Ethylenediamine-N,N,N',N'-tetramethylenephosphonic Acid: 0.3 g
Benzotriazole: 1.0 g
Water to make: 1 liter
pH adjusted by sodium hydroxide to: 7.5

After the continuous processing, the sample prepared above which had been subjected to step exposure for sensitometry was processed in the same manner as described above and the minimum density of yellow was measured.

Furthermore, the sample thus processed was allowed to stand for 30 days at 80° C. and the minimum density of yellow after the passage of time was measured. The results obtained are shown in Table 9 below.

TABLE 9

| No. | Benzyl Alcohol*1 (ml/liter)/ Diethylene Glycol (ml/liter) | Sodium 1,2-cyclohexane-diamine-tetraacetate*2 (g/liter) | Replenisher to Stabilization (3) ($ml/m^2$) | Replenisher/ Solution from Pre-bath | Minimum Coloring Density of Yellow (yellow stain) | Stain after 30 Days (80° C.) |
|---|---|---|---|---|---|---|
| 61 | 0 | 0 | 5,000 | 83/1 | 0.12 | 0.32 |
| 62 | 0 | 0 | 2,000 | 33/1 | 0.15 | 0.35 |
| 63 | 0 | 0 | 200 | 3.3/1 | 0.20 | 0.41 |
| 64 | 0 | 0 | 25 | 0.4/1 | 0.38 | 0.51 |
| 65 | 10/15 | 0 | 2,000 | 33/1 | 0.20 | 0.38 |
| 66 | 10/15 | 0.5 | 2,000 | 33/1 | 0.17 | 0.34 |
| 67 | 0 | 0.5 | 2,000 | 33/1 | 0.11 | 0.29 |
| 68 | 10/15 | 0 | 200 | 3.3/1 | 0.29 | 0.44 |
| 69 | 0 | 0.5 | 200 | 3.3/1 | 0.12 | 0.31 |
| 70 | 10/15 | 0 | 25 | 0.4/1 | 0.39 | 0.60 |
| 71 | 0 | 2.0*3 | 25 | 0.4/1 | 0.15 | 0.31 |

*1Same as Table 6 in Example 6.
*2Tank solution concentration. The replenisher concentration was 0.55 g/liter.
*3Tank solution concentration. The replenisher concentration was 2.1 g/liter.
Nos. 61–66, 68, and 70: comparison examples
Nos. 67, 69, and 71: examples of this invention.

From the results shown in Table 9 above, it can be seen that Comparison Sample Nos. 61 to 64 wherein the amount of the replenisher was reduced in succession show the increase of stain with the reduction of the amount of the replenisher. On the other hand, when benzyl alcohol exists, the formation of stain is increased in the case that the amount of the replenisher is less than 50 times, regardless of the chelating compound in this invention (Comparison Sample Nos. 65, 66, 68, and 70). On the other hand, when benzyl alcohol does not exist and the chelating compound in this invention exists in the color developer, the formation of stain is remarkably inhibited (Sample Nos. 67 and 69).

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material after imagewise exposure, comprising color developing, desilvering, and at least one of washing and stabilizing a silver halide color photographic material, wherein a color developer which does not contain more than 2 ml/l benzyl alcohol but comprises at least one compound represented by formula (I)

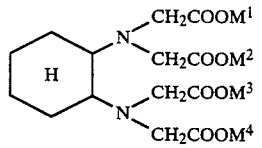

(I)

wherein $M^1$, $M^2$, $M^3$ and $M^4$ each represents a hydrogen atom, an alkali metal ion, an ammonium ion, or 1/n of an n-valent cation is used for the color development.

2. A method for processing a silver halide color photographic material as in claim 1, wherein the total processing time for washing and stabilization is from 20 seconds to 2 minutes.

3. A method for processing a silver halide color photographic material as in claim 1, wherein washing, stabilization, or washing and stabilization is performed by a multi-stage countercurrent system using plural tanks, and a replenisher is added thereto in an amount of from 0.5 to 50 times the amount of processing solution carried thereinto per unit area of the color photographic material from a pre-bath.

4. A method for processing a silver halide color photographic material as in claim 2, wherein washing, stabilization, or washing and stabilization is performed by a multi-stage countercurrent system using plural tanks, and a replenisher is added thereto in an amount of from 0.5 to 50 times the amount of processing solution carried thereinto per unit area of the color photographic material from a pre-bath.

5. A method for processing a silver halide color photographic material as in claim 1, wherein the compound represented by formula (I) is contained in the color developer in an amount of from 0.001 g to 30 g per liter of the color developer.

6. A method for processing a silver halide color photographic material as in claim 1, wherein the compound represented by formula (I) is contained in the color developer in an amount of from 0.01 g to 5 g per liter of the color developer.

7. A method for processing a silver halide color photographic material as in claim 3, wherein the replenisher is added in an amount of from 3 to 30 times the amount of processing solution carried thereinto per unit area of the color photographic material from the pre-bath.

8. A method for processing a silver halide color photographic material as in claim 4, wherein the replenisher is added in an amount of from 3 to 30 times the amount of processing solution carried thereinto per unit area of the color photographic material from the pre-bath.

9. A method for processing a silver halide color photographic material as in claim 2, wherein the total processing time for washing and stabilization is from 20 seconds to 1 minute and 30 seconds.

10. A method for processing a silver halide color photographic material as in claim 9, wherein washing, stabilization, or washing and stabilization is performed by a multi-stage countercurrent system using plural tanks, and a replenisher is added thereto in an amount of from 0.5 to 50 times the amount of processing solution carried thereinto per unit area of the color photographic material from a pre-bath.

* * * * *